US008343698B2

(12) United States Patent
Kawasaki et al.

(10) Patent No.: US 8,343,698 B2
(45) Date of Patent: Jan. 1, 2013

(54) PHOTORECEPTOR, METHOD OF MANUFACTURING SAME, IMAGE FORMATION METHOD, IMAGE FORMING APPARATUS, AND PROCESS CARTRIDGE

(75) Inventors: Yoshiaki Kawasaki, Susono (JP); Kazukiyo Nagai, Numazo (JP); Yukio Fujiwara, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 418 days.

(21) Appl. No.: 12/718,622

(22) Filed: Mar. 5, 2010

(65) Prior Publication Data

US 2010/0227264 A1 Sep. 9, 2010

(30) Foreign Application Priority Data

Mar. 5, 2009 (JP) ..... 2009-052636

(51) Int. Cl.
*G03G 5/00* (2006.01)

(52) U.S. Cl. ..... 430/58.05; 430/66; 430/132

(58) Field of Classification Search ..... 430/58.05, 430/132, 66; 399/159
See application file for complete search history.

(56) References Cited

U.S. PATENT DOCUMENTS

| | | | | |
|---|---|---|---|---|
| 4,956,440 | A | 9/1990 | Limburg et al. | |
| 5,411,827 | A | 5/1995 | Tamura et al. | |
| 5,496,671 | A | 3/1996 | Tamura et al. | |
| 7,179,573 | B2 * | 2/2007 | Suzuki et al. | 430/66 |
| 7,361,438 | B2 | 4/2008 | Suzuki et al. | |
| 7,399,563 | B2 | 7/2008 | Suzuki et al. | |
| 2004/0248024 | A1 | 12/2004 | Suzuki et al. | |
| 2007/0122724 | A1 | 5/2007 | Suzuki et al. | |
| 2008/0020305 | A1 | 1/2008 | Suzuki et al. | |

FOREIGN PATENT DOCUMENTS

| | | |
|---|---|---|
| JP | 56-48637 | 5/1981 |
| JP | 3194392 | 6/2001 |
| JP | 3262488 | 12/2001 |
| JP | 3286711 | 3/2002 |
| JP | 3344003 | 8/2002 |
| JP | 2004-302452 | 10/2004 |
| JP | 4145820 | 6/2008 |
| JP | 4266859 | 2/2009 |

OTHER PUBLICATIONS

"Present and Prospect of UVEB Radiation Curing Technology" (reference for safety on remaining of catalyst), published by CMC Publishing Co., Ltd on Dec. 27, 2002.

"Mutation test in Ordinance on Safety and Hygiene—Guideline and GLP", published by Japan industrial Safety & Health Association, on Mar. 25, 1991.

* cited by examiner

*Primary Examiner* — Mark A Chapman
(74) *Attorney, Agent, or Firm* — Cooper & Dunham LLP

(57) ABSTRACT

A photoreceptor including an electroconductive substrate, a photosensitive layer located overlying the electroconductive substrate, and a surface layer located overlying the photosensitive layer, the surface layer including a cross-linked material of a radical polymerizable monomer having at least 3 functional groups with no charge transport structure and a radical polymerizable compound having a charge transport structure, the surface layer having a sulfur concentration of 50 ppmw or lower.

10 Claims, 2 Drawing Sheets

PHOTORECEPTOR, METHOD OF MANUFACTURING SAME, IMAGE FORMATION METHOD, IMAGE FORMING APPARATUS, AND PROCESS CARTRIDGE

BACKGROUND OF THE INVENTION

1. Field of the Invention

The present invention relates to a photoreceptor and a manufacturing method thereof, a method of image formation, image forming apparatus, and a process cartridge.

2. Discussion of the Background

Recently, organic photoconductors (photoreceptors) have been used in place of inorganic photoreceptors for a photocopier, a facsimile machine, a laser printer and a multi-functional device thereof in light of performances and advantages. Specific reasons for this replacement are, for example, (1) good optical characteristics, for example, width of the range of optical absorption wavelength and size of the amount of absorption of light; (2) electric characteristics, for example, high sensitivity and stable chargeability; (3) a wide selection of materials; (4) ease of manufacturing; (5) inexpensive cost; and (6) toxic-free property.

In addition, the trend of the size reduction of an image forming apparatus has accelerated the size reduction of an image bearing member (photoreceptor). Therefore, with the advancement of high speed performance and maintenance-free, a photoreceptor (image bearing member) having a high durability has been desired. From this point of view, an organic photoconductor is soft in general and easy to wear down because the surface layer thereof is mainly made of a low molecular weight charge transport material and an inert polymer. Thus, an organic photoconductor repetitively used in the electrophotography process tends to be abraded under mechanical stress by a developing system or a cleaning system. Currently, this is a significant problem because the cleaning property of the photoreceptor should be improved to deal with size-reduced toner particles demanded for production of quality images so that usage of hard rubber for the cleaning blade and an increase in the contact pressure between the cleaning blade and the photoreceptor are inevitable.

Such abrasion of a photoreceptor causes deterioration of electric characteristics, for example, the sensitivity and the chargeability, resulting in production of abnormal images having, for example, low image density and background fouling. Local abrasion damage to a photoreceptor causes streaks on an image due to bad cleaning performance on the photoreceptor. Therefore, such abrasion and damage determine the working life of a photoreceptor and lead to replacement thereof.

Therefore, the reduction of the abrasion amount is inevitable to manufacture an organic photoconductor having a long working life and creates the most imminent issue in this field.

With regard to improvement on the anti-abrasion property of the photosensitive layer, for example, unexamined published Japanese patent application No. (hereinafter referred to as JOP) S56-48637 describes a technology of using a curable binder resin in the surface layer. JOP S64-1728 describes a technology of using a charge transport polymer. JOP H04-281461 describes a technology of dispersing an inorganic filler in the surface layer. Among these technologies, the curable binder resin in the surface layer has poor compatibility with a charge transport material and impurities such as a polymerization initiator and non-reacted residual group tend to raise the residual voltage, which leads to deterioration of image density.

In addition, the technology of using the charge transport polymer and the technology of dispersing an inorganic filler in the surface layer improve the abrasion resistance and improvement on these technologies are demanded for further extended period of use of an organic photoconductor.

Furthermore, the technology of dispersing an inorganic filler in the surface layer tends to cause trap of charge carrier existing on the surface of the inorganic filler, which leads to a rise of residual voltage. Therefore, image density easily decreases. Thus, a measurement to deal with such image density reduction is required. In conclusion, these technologies need improvement on comprehensive durability suitable for an organic photoconductor including electric durability and mechanical strength.

Furthermore, Japanese patent No. (hereinafter referred to as JP) 3262488 describes a technology of improving abrasion resistance and damage resistance by using a photoreceptor including multi-functional cured acrylate monomer. JP 3262488 has a description about usage of the multi-functional cured acrylate monomer in a protection layer provided on the photosensitive layer but inclusion of a charge transport material in the protection layer is just mentioned with no specific description. Furthermore, the multi-functional cured acrylate monomer has a compatibility problem with a charge transport material having a low molecular weight simply contained in the surface layer, thereby causing precipitation of the low molecular weight charge transport material and white turbidity. This easily degrades the mechanical strength.

Furthermore, to be specific, the photoreceptor is formed by reaction of monomers in the state in which binder polymers are contained. This creates problems of insufficient curing reaction, and compatibility between the cured material and the binder resin. Thus, a rough surface is easily manufactured due to the phase separation in the curing reaction, which leads to bad cleaning performance.

Abrasion resistance technologies instead of the technologies described above have been thus introduced. For example, JP 3194392 describes a technology of forming a charge transport layer by a liquid application containing a monomer having a carbon-carbon double bonding, a charge transport material having a carbon-carbon double bonding and a binder resin. This binder resin includes a resin having a carbon-carbon double bonding with reactivity with the charge transport material and another resin having no carbon-carbon double bonding with no reactivity with the charge transport material. This photoreceptor has a good combination of abrasion resistance and electric characteristics. However, the resin having no carbon-carbon double bonding with no reactivity with the charge transport material has poor compatibility with a cured material produced in the reaction of the monomer and the charge transport material. Thus, a rough surface is easily formed while in the phase separation and cross-linking, which results in bad cleaning performance.

In addition to the blocking of monomer curing by, the binder resin as described above, the monomers specified in the technology are two functional, meaning that the number of functional groups is insufficient to obtain a sufficient cross linking density. Therefore, the obtained photoreceptor does not have sufficient abrasion resistance.

Furthermore, when the binder resin having a reactivity is used, it is difficult to have a good combination of the bonding amount of the charge transport material and the cross-linking density since the monomer and the binder resin have a small number of functional groups. Therefore, the obtained photoreceptor has insufficient electric characteristics and abrasion resistance.

A surface layer did not used to be formed by simple application of a liquid application of monomer and cross-linking and/or elongation reaction without using a solid resin from which the status of the surface layer is relatively easy to predict. However, recently a technology of improving both the electric characteristics and the abrasion resistance has been introduced in which the surface of a cured cross-linked resin layer is formed by curing a radical polymerizable monomer (1) having at least 3 functional groups with no charge transport structure and a radical polymerizable compound (2) having a charge transport structure (refer to, for example, JOPs 2004-302450, 2004-302451, and 2004-302452).

The radical polymerizable monomer (1) is easily available from the market but the purity thereof is generally low and contains impurities deriving from catalysts, etc. These degrade abrasion resistance and electric characteristics.

In addition, some of the among radical polymerizable monomers (1) are not safe. This safety problem is ascribable to the impurities contained in the radical polymerizable monomer (1), particularly residuals relating to the catalyst.

SUMMARY OF THE INVENTION

Because of these reasons, the present inventors recognize that a need exists for a photoreceptor (photoconductor, image bearing member) that has high and stable abrasion resistance and damage resistance even inside the surface layer with good electric characteristics and produces quality images for a long period of time, a method of manufacturing the photoreceptor, and an image forming apparatus and a process cartridge using the photoreceptor.

Furthermore, as the interest on the safety of chemical compounds has been increasing recently, the present invention particularly provides a photoreceptor that indicates negative in Ames test, which is used as a method of easily determining carcinogenicity, and a method of providing the photoreceptor, and an image forming apparatus and a process cartridge using the photoreceptor.

Accordingly, an object of the present invention is to provide a safe photoreceptor (photoconductor, image bearing member) that has high and stable abrasion resistance and damage resistance even inside the surface layer with good electric characteristics and produces quality images for a long period of time, a method of manufacturing the photoreceptor, and an image forming apparatus and a process cartridge using the photoreceptor.

Briefly this object and other objects of the present invention as hereinafter described will become more readily apparent and can be attained, either individually or in combination thereof, by a photoreceptor including an electroconductive substrate, a photosensitive layer located overlying the electroconductive substrate, and a surface layer located overlying the photosensitive layer, the surface layer including a cross-linked material of a radical polymerizable monomer having at least 3 functional groups with no charge transport structure and a radical polymerizable compound having a charge transport structure, the surface layer having a sulfur concentration of 50 ppmw or lower.

It is preferable that, in the photoreceptor mentioned above, the radical polymerizable monomer having at least 3 functional groups with no charge transport structure has a sulfur concentration of 50 ppmw or lower.

As another aspect of the present invention, a method of manufacturing a photoreceptor is provided which includes refining a radical polymerizable monomer having at least 3 functional groups with no charge transport structure such that the radical polymerizable monomer having at least 3 functional groups with no charge transport structure has a sulfur concentration of 90 ppmw or less, forming a photosensitive layer comprising a charge transport material overlying an electroconductive substrate, and forming a surface layer overlying the photosensitive layer by applying a liquid application of the surface layer comprising the radical polymerizable monomer having at least 3 functional groups with no charge transport structure and a radical polymerizable compound having a charge transport structure, followed by curing and cross-linking upon application of an optical energy, whereby a sulfur concentration of the surface layer is 50 ppmw or less.

It is preferable that, in the step of refining in the method of manufacturing the photoreceptor mentioned above, the radical polymerizable monomer having at least 3 functional groups with no charge transport structure is refined such that a ratio of a total number of colonies calculated according to a mutation test of Ames Test using salmonella of TA1535 to a number of colonies of a control solvent according thereto is 2.0 at maximum.

It is preferable that, in the step of refining in the method of manufacturing the photoreceptor mentioned above, the radical polymerizable monomer having at least 3 functional groups with no charge transport structure is refined by separation refinement according to column chromatography.

It is preferable that, in the step of refining in the method of manufacturing the photoreceptor mentioned above, the radical polymerizable monomer having at least 3 functional groups with no charge transport structure is refined by absorption refinement using an absorbent.

It is preferable that, in the step of refining in the method of manufacturing the photoreceptor mentioned above, the absorbent in the step of refining is basic.

As another aspect of the present invention, an image formation method is provided which includes charging the photoreceptor mentioned above, irradiating the photoreceptor to form a latent electrostatic image thereon, developing the latent electrostatic image with a development agent to obtain a visualized image and transferring the visualized image to a transfer medium.

As another aspect of the present invention, an image forming apparatus is provided which includes the photoreceptor mentioned above, an irradiation device that irradiates the photoreceptor with light to form a latent electrostatic image thereon, a development device that develops the latent electrostatic image with a development agent to obtain a visualized image, and a transfer device that transfers the visualized image to a transfer medium.

As another aspect of the present invention, an image forming apparatus is provided which includes the photoreceptor mentioned above and at least one of a charging device, a development device, a transfer device, a discharging device and a cleaning device.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
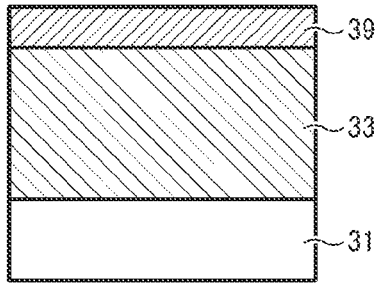
FIG. 1 is a diagram illustrating a cross section of an example of the photoreceptor of the present invention.

The present invention includes an electroconductive substrate, on which at least a photosensitive layer located overlying the electroconductive substrate and a surface layer located overlying the photosensitive layer. The photosensitive layer includes at least a charge generation compound and a charge transport compound. The surface layer includes a cross-linked material formed by polymerization of a radical polymerizable monomer having at least 3 functional groups with no charge transport structure and a radical polymerizable compound with a charge transport structure and sulfur with a density of 50 ppm or lower as a result of refinement by removing a remaining catalyst containing sulfur. Thus, the photoreceptor is safe and produces quality images for an extended period of time.

In addition, the present invention includes the method of manufacturing a photoreceptor including a process of forming a photosensitive layer containing a charge transport material on an electroconductive substrate, and a process of forming a surface layer and the surface layer is formed by: (i) application of a liquid application for the surface layer containing: (I) a radical polymerizable monomer having at least 3 functional groups with no charge transport structure which is refined such that the radical polymerizable monomer having at least 3 functional groups with no charge transport structure has a sulfur density of 90 ppmw or less, and (II) a radical polymerizable compound having a charge transport structure, and (ii) followed by curing and cross-linking upon application of an optical energy. Also, in the surface layer, the sulfur concentration of the surface layer is 50 ppmw or less. Therefore, according to this method, a safe photoreceptor is provided which produces quality images for an extended period of time with an excellent durability and electric characteristics.

The considerable reasons are as follows.

The surface layer of the photoreceptor in the present invention is formed by polymerization of a radical polymerizable monomer having at least 3 functional groups with no charge transport structure and a radical polymerizable compound having a charge transport structure. Thus, three-dimension networks are developed in the polymerization reaction, which results in formation of the surface layer of a cross-linking structure having an extremely high density and a high charge transport property. However, a sulfur-based acid catalyst used in synthesis of the radical polymerizable monomer having at least 3 functional groups with no charge transport structure causes carrier trap, etc., which degrades the charge transport property. Furthermore, the sulfur based catalyst remaining in the radical polymerizable monomer degrades the electric characteristics and causes safety problem.

Therefore, in the present invention, the sulfur concentration in the surface layer, which is a cross-linked material formed by polymerization of the radical polymerizable monomer having at least 3 functional groups with no charge transport structure and the radical polymerizable compound having a charge transport structure, is reduced to 50 ppm or lower to prevent decrease in the chargeability and occurrence of carrier trap and reduce hazard and/or burden on human body and environment.

Next, the material forming the liquid application for the surface layer is described.

Radical Polymerizable Monomer Having at Least 3 Functional Groups with No Charge Transport Structure The radical polymerizable monomer having at least 3 functional groups with no charge transport structure represents a monomer having at least 3 radical polymerizable functional group without a positive hole structure such as triaryl amine, hydrazone, pyrazoline, or carbazole, or an electron transport structure such as condensed polycyclic quinone, diphenoquinone or an electron absorbing aromatic ring having a cyano group or a nitro group.

The radical polymerizable functional group is any radical polymerizable functional group which has a carbon-carbon double bond. For example, 1-substituted ethylene functional groups and 1,1-substituted ethylene functional groups are suitably used as the radical polymerizable functional group.

A specific example of 1-substituted ethylene functional groups is the functional group represented by the following chemical formula 1.

$$CH_2{=}CH{-}X^2 \qquad \text{Chemical formula 1}$$

In the chemical formula 1, $X^2$ represents an arylene group such as a substituted or non-substituted phenylene group, and a naphthylene group, a substituted or non-substituted alkenylene group, —CO—, —COO—, —CON($R^{36}$) (where $R^{36}$ represents hydrogen, an alkyl group such as methyl group and ethyl group, an aralkyl group such as benzyl group, naphthyl methyl group, and phenethyl group, and an aryl group such as phenyl group and naphthyl group), or —S—.

Specific examples of such functional groups include, but are nor limited to, vinyl group, styryl group, 2-methyl-1,3-butadienyl group, vinyl carbonyl group, acryloyloxy group, acryloyl amide group, and vinylthio ether group.

A specific examples of 1,1-substituted ethylene functional groups is the functional group represented by the following chemical formula 2.

$$CH_2{=}C(Y^4){-}X^3 \qquad \text{Chemical formula 2}$$

In Chemical formula 2, $Y^4$ represents an alkyl group optionally having a substitution group, an aralkyl group optionally having a substitution group, a phenylene group optionally having a substitution group, an aryl group, a halogen atom, cyano group, nitro group, an alkoxy group such as methoxy group or ethoxy group, or —$COOR^{37}$. $X^3$ represents the same group as those specified for $X^2$, a single bond or an alkylene group.

At least one of $Y^4$ and $X^3$ is a group selected from the group consisting of an oxycarbonyl group, cyano group, an alkenylene group and an aromatic ring. $R^{37}$ represents hydrogen atom, an alkyl group such as methyl group and ethyl group optionally having a substitution group, an aralkyl group such as benzyl group and phenetyl group optionally having a substitution group, a phenyl group, an aryl group such as phenyl group and naphtyl group optionally having a substitution group, or —$CONR^{38}R^{39}$ ($R^{38}$ and $R^{39}$ independently represent hydrogen atom, an alkyl group such as methyl group and ethyl group optionally having a substitution group, an aralkyl group such as benzyl group, naphtyl methyl group and phenetyl group optionally having a substitution group).

Specific examples of these functional groups include, but are nor limited to, α-acryloyloxy chloride group, methacryloyloxy group, α-cyanoethylene group, α-cyanoacryloyloxy group, α-cyanophenylene group and methacryloyl amino group.

Specific examples of substitution groups further substituted to the substitution groups of $X^2$, $X^3$ and $Y^4$ include, but are not limited to, a halogen atom, nitro group, cyano group, an alkyl group such as methyl group and ethyl group, an alkoxy group such as methoxy group and ethoxy group, aryloxy group such as phenoxy group, aryl group such as phenyl group and naphtyl group, and an aralkyl group such as benzyl group and phenetyl group.

Among these radical polymerizable functional groups, acryloyloxy group, and methacyloyloxy group are particularly suitable. A compound having at least three acryloyloxy groups is obtained by performing ester reaction or ester conversion reaction using, for example, a compound having at least three hydroxyl groups therein and an acrylic acid (salt), a halide acrylate and an ester of acrylate. A compound having at least three methacryloyloxy groups is obtained in the same manner. In addition, the radical polymerizable functional groups in a monomer having at least three radical polymerizable functional groups can be the same or different from each other.

Specific examples of the radical polymerizable monomer having at least three functional groups with no charge transport structure include, but are not limited to, the following compounds, but are not limited thereto.

Specific examples of the radical polymerizable monomers mentioned above for use in the present invention include, but are not limited to, trimethylol propane triacrylate (TMPTA), trimethylol propane trimethacrylate, HPA modified trimethylol propane triacrylate, EO modified trimethylol propane triacrylate, PO modified trimethylol propane triacrylate, caprolactone modified trimethylol propane triacrylate, HPA modified trimethylol propane triacrylate, pentaerythritol triacrylate, pentaerythritol tetra acrylate (PETTA), glycerol triacrylate, ECH modified glycerol triacrylate, EO modified glycerol triacrylate, PO modified glycerol triacrylate, tris (acryloxyrthyl) isocyanulate, dipenta erythritol hexacrylate (DPHA), caprolactone modified dipenta erythritol hexacrylate, dipenta erythritol hydroxyl dipenta acrylate, alkylized dipenta erythritol tetracrylate, alkylized dipenta erythritol triacrylate, dimethylol propane tetracrylate (DTMPTA), penta erythritol ethoxy tetracrylate, EO modified phosphoric acid triacrylate, and 2,2,5,5-tetrahydroxy methyl cyclopentanone tetracrylate. These can be used alone or in combination.

In general, a sulfur-based acid catalyst such as paratoluene sulfuric acid is used to synthesize the radical polymerizable monomer mentioned above. The sulfur-based acid catalyst, if remaining in the radical polymerizable monomer, degrades the chargeability and causes formation of carrier trap, which also affects safety to human bodies. Therefore, reduction of the sulfur-based acid catalyst remaining in the radical polymerizable monomer is suitable.

Various kinds of refinement methods can be used to remove the impurities mentioned above. Among these, a separation refinement method according to column chromatography and a absorption refinement using an absorbent are suitable.

Specific examples of the absorbents for use in such a separation refinement method according to column chromatography and an absorption refinement method according to an absorbent include, but are not limited to, diatom earth, bentonite, zeolite, acid clay, activated earth, activated charcoal, silica gel, alumina, and florisil. Among these, silica gel is suitable to separate sulfur portion in the separation refinement method according to column chromatography. On the other hand, activated earth and activated alumina are suitable to remove sulfur portion in the absorption refinement method. Among these, basic activated alumina has a great absorption effect for the sulfur-based acid catalyst.

One time absorption refinement treatment is effective but multiple time absorption refinement treatments are preferable to improve the removal effect of the impurities. A number of methods for use in the present invention of measuring the safety of the radical polymerizable monomer can be used. Ames test (mutagen test) is employed in the present invention.

Ames test is a test in which germs are used. The strain among salmonellas used in the test is histidine auxotroph (his−), which cannot synthesize histidine. In the test, the number of colonies of recoveries from histidine auxotroph (his−) to (his+) which can synthesize histidine again as a result of a test material reacting with the strain is counted to determine the mutation property of the material.

Currently, among these strains, TA1535, TA1537, TA100, TA98 or WP2uvrA—are generally used. When TA1535 is used, radical polymerizable monomers in the market are frequently positive. Therefore, TA1535 test is employed in the present invention. Typically in the mutation test, the direct test in which a test material is directly caused to react with a strain is conducted in combination with the metabolic activation test in which a metabolic activation enzyme (S-9Mix) obtained from a liver of a rat, etc., is incorporated to make the drug metabolism of a microscopic organism close to that of a mammal.

"Mutation test in Ordinance on Safety and Hygiene—Guideline and GLP— (published by Japan industrial Safety & Health Association)" is referred to with regard to the specific test method.

The content ratio of the radical polymerizable monomer having at least three functional groups with no charge transport structure is from 20 to 80% by weight and preferably from 30 to 70% by weight based on the total weight of a surface layer. When the monomer content ratio is too small, the density of three-dimensional cross-linking bond in the surface layer tends to be low. Therefore, the abrasion resistance thereof is not drastically improved in comparison with a case in which a typical thermoplastic binder resin is used. A monomer content ratio that is too large means that the content of charge transport compound decreases, which may cause deterioration of the electric characteristics. Desired electric characteristics and anti-abrasion property vary depending on the process used. Therefore, it is difficult to jump to any conclusion but considering the balance of the characteristics and the property, the range of from 30 to 70% by weight is preferred.

Radical Polymerizable Compound Having Charge Transport Structure

The radical polymerizable compound with a charge transport structure represents a compound having a radical polymerizable functional group, and a positive hole structure such as triaryl amine, hydrazone, pyrazoline, or carbazole, or an electron transport structure such as condensed polycyclic quinone, diphenoquinone or an electron absorbing aromatic ring having a cyano group or a nitro group. As the radical polymerizable functional group, the radical polymerizable functional group mentioned in the radical polymerizable monomer mentioned above can be suitably used. Among these, acryloyloxy group and methcryloyloxy group are particularly suitable.

In addition, the radical polymerizable compound with a charge transport structure can have two or more functional groups but preferably one functional group in terms of membrane and electrostatic characteristics. This is thought to be because since a radical polymerizable compound having two or more functional groups with a charge transport structure is fixed in the cross linking structure by multiple bondings and the charge transport structure is extremely bulky, the cured resin is distorted and thus the surface layer has a strong internal stress, which easily leads to cracking or damage due to carrier attachment.

This causes no problem when the layer thickness is thin, e.g., 5 micro meter of less. However, the internal stress in a layer thickness that is too thick extremely increases and easily invites cracking immediately after cross-linking.

With regard to the electrostatic characteristics, since a radical polymerizable compound having two or more functional groups with a charge transport structure is fixed in the cross linking structure, the intermediate structure (cation radical) during charge transport is unstable, resulting in deterioration of sensitivity due to charge trap and rise in the residual voltage. Deterioration as to the electrostatic characteristics of a photoreceptor affects image formation relating to image density and breadth of lines and characters. Therefore, a radical polymerizable compound with a charge transport structure having one functional group is suitable for prevention of occurrence of cracking and damage, and stabilization of the electrostatic characteristics because such a radical polymerizable compound with a charge transport structure is fixed between cross-linking bondings in a pendulous manner.

In addition, a triaryl amine structure is effective as the charge transport structure.

Furthermore, a triaryl amine structure having one functional group is preferable and a compound having a structure represented by the following chemical formula I or II is suitable to sustain the electrostatic characteristics such as sensitivity and residual voltage.

Chemical formula (I)

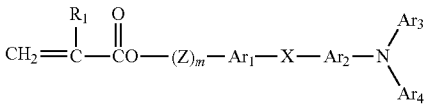

Chemical formula (II)

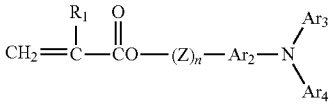

In Chemical formulae I and II, $R_1$ represents a functional group selected from the group consisting of hydrogen atom, a halogen atom, a substituted or unsubstituted alkyl group, a substituted or unsubstituted aralky group, a substituted or unsubstituted aryl group, cyano group, nitro group, an alkoxy group, —$COOR^7$, a halogenated carbonyl group and $CONR^8R^9$. $Ar^1$ and $Ar^2$ independently represent a substituted or unsubstituted arylene group $Ar^3$ and $Ar^4$ independently represent a substituted or unsubstituted aryl group. X represents a single bond, a functional group selected from the group consisting of a single bond, a substituted or non-substituted alkylene group, a substituted or non-substituted cycloalkylene group, a substituted or non-substituted alkylene ether group, oxygen atom, sulfur atom or a vinylene group. Z represents a substituted or non-substituted alkylene group, a substituted or non-substituted alkylene ether group or an alkyleneoxy carbonyl group. "m" and "n" represent an integer of from 0 to 3. $R^7$ represents hydrogen atom, a substituted or non-substituted alkyl group, a substituted or non-substituted aralkyl group or a substituted or non-substituted aryl group. $R^8$ and $R^9$ independently represent a functional group selected from the group consisting of hydrogen atom, a halogen atom, a substituted or unsubstituted alkyl group, a substituted or unsubstituted aralky group, and a substituted or unsubstituted aryl group.

Specific examples of 1-substituted ethylene functional groups and 1,1-substituted ethylene functional groups are as follows.

In the Chemical formulae I and II, as the substitution groups of $R^1$, specific examples of the alkyl groups of $R^1$ include, but are not limited to, methyl group, ethyl group, propyl group, and butyl group. Specific examples of the aryl groups of $R^1$ include, but are not limited to, phenyl group and naphtyl group. Specific examples of the aralkyl groups of $R^1$ include, but are nor limited to, benzyl group, phenthyl group, naphtyl methyl group. The alkoxy group $R^1$ includes, but is nor limited to, methoxy group, ethoxy group and propoxy group. These can be substituted by a halogen atom, nitro group, cyano group, an alkyl group such as methyl group and ethyl group, an alkoxy group such as methoxy group and ethoxy group, an aryloxy group such as phenoxy group, an aryl group such as phenyl group and naphtyl group and an aralkyl group such as benzyl group and phenthyl group. Among these substitution groups for $R^1$, hydrogen atom and methyl group are particularly preferable.

$Ar^3$ and $Ar^4$ represent a substituted or non-substituted aryl group. Specific examples thereof include, but are not limited to, condensed polycyclic hydrocarbon groups, non-condensed ring hydrocarbon groups and heterocyclic groups.

Specific examples of the condensed polycyclic hydrocarbon groups include, but are not limited to, a group in which the number of carbons forming a ring is not greater than 18 such as pentanyl group, indenyl group, naphtyl group, azulenyl group, heptalenyl group, biphenylenyl group, as-indacenyl group, s-indacenyl group, fluorenyl group, acenaphtylenyl group, pleiadenyl group, acenaphtenyl group, phenalenyl group, phenanthryl group, anthryl group, fluorantenyl group, acephenantrirenyl group, aceantrirenyl group, triphenylene group, pyrenyl group, chrysenyl group, and naphthacenyl group.

Specific examples of the non-condensed ring hydrocarbon groups include, but are not limited to, a single-valent group of monocyclic hydrocarbon compounds such as benzene, diphenyl ether, polyethylene diphenyl ether, diphenylthio ether and phenylsulfon, a single-valent group of non-condensed polycyclic hydrocarbon compounds such as biphenyl, polyphenyl, diphenyl alkane, diphenyl alkene, diphenyl alkyne, triphenyl methane, distyryl benzene, 1,1-diphenyl cycloalkane, polyphenyl alkane and polyphenyl alkene or a single-valent group of ring aggregated hydrocarbon compounds such as 9,9-diphenyl fluorene.

Specific examples of the heterocyclic groups include, but are not limited to, a single-valent group such as carbazol, dibenzofuran, dibenzothiophene, oxadiazole, and thiadiazole.

The aryl groups represented by $Ar^3$ and $Ar^4$ can have a substitution group. Specific examples thereof are as follows:

(1) Halogen atom, cyano group, and nitro group;

(2) Alkyl group;

Preferably a straight chained or side chained alkyl group having 1 to 12, more preferably 1 to 8 and furthermore preferably from 1 to 4 carbons. These alkyl groups can have a fluorine atom, a hydroxyl group, an alkoxy group having 1 to 4 carbon atoms, a phenyl group or a phenyl group substituted by a halogen atom, an alkyl group having 1 to 4 carbon atoms or an alkoxy group having 1 to 4 carbon atoms. Specific examples thereof include, but are not limited to, methyl group, ethyl group, n-butyl group, i-propyl group, t-butyl group, s-butyl group, n-propyl group, trifluoromethyl group, 2-hydroxy ethyl group, 2-ethoxyethyl group, 2-cyanoethyl group, 2-methoxyethyl group, benzyl group, 4-chlorobenzyl group, 4-methyl benzyl group and 4-phenyl benzyl group;

(3) Alkoxy group (—$OR^2$); $R^2$ represents the alkyl group defined in (2). Specific examples thereof include, but are not limited to, methoxy group, ethoxy group, n-propoxy group, i-propoxy group, t-butoxy group, n-butoxy group, s-butoxy group, i-butoxy group, 2-hydroxy ethoxy group, benzyl oxy group, and trifluoromethoxy group;

(4) Aryloxy group; The aryl group thereof is, for example, phenyl group and naphtyl group. These can contain an alkoxy group having 1 to 4 carbon atoms, an alkyl group having a 1 to 4 carbon atoms, or a halogen atom as a substitution group. Specific examples include, but are not limited to, phenoxy group, 1-naphtyloxy group, 2-naphtyloxy group, 4-methoxyphenoxy group, and 4-methylphenoxy group;

(5) Alkylmercapto group or an arylmercapto group

Specific examples of these groups include, but are not limited to, methylthio group, ethylthio group, phenylthio group, and p-methylphenylthio group.

Chemical formula 3

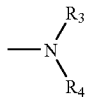

(6)

In Chemical formula 3, $R^3$ and $R^4$ independently represent hydrogen atom, the alkyl group defined in (2), or an aryl group.

Specific examples of the aryl groups include, but are not limited to, phenyl group, biphenyl group, or naphtyl group. These can contain an alkoxy group having 1 to 4 carbon atoms, an alkyl group having 1 to 4 carbon atoms or a halogen atom as a substitution group. $R^3$ and $R^4$ can share a linkage to form a ring.

Specific examples thereof include, but are not limited to, amino group, diethyl amino group, N-methyl-N-phenyl amino group, N,N-diphenyl amino group, N,N-di(tolyl) amino group, dibenzyl amino group, piperidino group, morpholino group, and pyrrolidino group;

(7) an alkylene dioxy group or an alkylene dithio such as methylene dioxy group and methylene dithio group; and (8) A substituted or non-substituted styryl group, a substituted or non-substituted β-phenyl styryl group, diphenyl aminophenyl group, ditolyl aminophenyl group, etc.

The arylene groups represented by $Ar^1$ and $Ar^2$ are divalent groups derived from the aryl group represented by $Ar^3$ and $Ar^4$ mentioned above.

X represents a single bond, a substituted or non-substituted alkylene group, a substituted or non-substituted cycloalkylene group, a substituted or non-substituted alkylene ether group, oxygen atom, sulfur atom, or vinylene group.

A straight chained or side chained alkylene group having 1 to 12, more preferably 1 to 8 and furthermore preferably from 1 to 4 carbons is preferably specified. These alkylene groups can have a fluorine atom, a hydroxyl group, a cyano group, an alkoxy group having 1 to 4 carbon atoms, a phenyl group or a phenyl group substituted by a halogen atom, an alkyl group having 1 to 4 carbon atoms or an alkoxy group having 1 to 4 carbon atoms. Specific examples thereof include, but are note limited to, methylene group, ethylene group, n-butylene group, i-propylene group, t-butylene group, s-butylene group, n-propylene group, trifluoromethylene group, 2-hydroxy ethylene group, 2-ethoxyethylene group, 2-cyanoethylene group, 2-methoxyethylene group, benzylidene group, phenyl ethylene group, 4-chlorophenyl ethylene group, 4-methylpheny ethylene group, and 4-biphenyl ethylene group.

Specific examples of the substituted or non-substituted cycloalkylene groups include, but are not limited to, cyclic alkylene group having 5 to 7 carbon atoms. These cyclic alkylene groups can have a fluorine atom, a hydroxyl group, an alkyl group having 1 to 4 carbon atoms, and an alkoxy group having 1 to 4 carbon atoms. Specific examples thereof include, but are not limited to, cyclohexylidene group, cyclohexylene group, and 3,3-dimethyl cyclohexylidene group.

Specific examples of the substituted or non-substituted alkylene ether group include, but are not limited to, ethyleneoxy, propyleneoxy, ethylene glycol, propylene glycol, diethylene glycol, tetraethylene glycol, and tripropylene glycol, and the alkylene group of the alkylene ether group may have a substitution group such as hydroxyl group, methyl group and ethyl group.

The vinylene group is represented by the following chemical formula 4.

Chemical formula 4

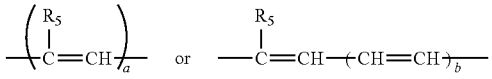

In the chemical formula 4, $R^5$ represents hydrogen, an alkyl group (the same as the alkyl groups defined in (2), an aryl group (the same as the aryl groups represented by $Ar^3$ and $Ar^4$ and "a" represents 1 or 2 and "b" is an integer of from 1 to 3.

Z represents a substituted or non-substituted alkylene group, a substituted or non-substituted alkylene ether group, or a substituted or non-substituted alkylene group. Specific examples of the substituted or non-substituted alkylene group are the same as the alkylene group specified for X. Specific examples of the substituted or non-substituted alkylene ether group are the same as the alkylene ether group specified for X. A specific example of the substituted or non-substituted alkyleneoxy carbonyl group is caprolactone modified group.

The compound represented by the following chemical formula (III) is a further suitably preferred radical polymerizable compound having a functional group with a charge transport structure.

Chemical formula III

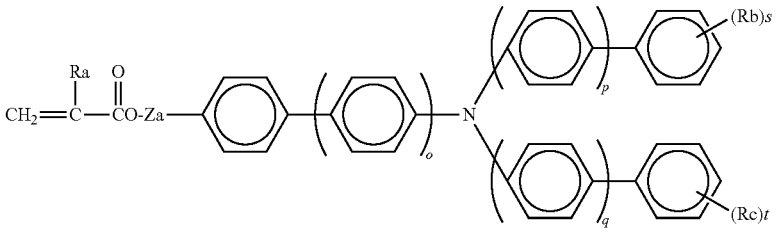

"o", "p", "q", each, independently, represent 0 or 1, s and t each, independently, represent 0 or an integer of from 1 to 3, $R^a$ represents hydrogen atom or methyl group, $R^b$ and $R^c$ each, independently, represent an alkyl group (excluding hydrogen atom) having 1 to 6 carbon atoms, and Za represents a single bond, methylene group, ethylene group, —$CH_2CH_2O$—, —$CHCH_3CH_2O$—, or —$C_6H_5CH_2CH_2$—.

Among the compounds represented by the chemical formula (III) illustrated above, the compounds having methyl group or ethyl group as a substitution group of Rb and Rc are particularly preferable.

The radical polymerizable compound having a functional group with a charge transport structure for use in the present invention represented by the chemical formulae I, II, or III in particular, is polymerized in a manner that both sides of the carbon-carbon double bond are open. Therefore, the radical polymerizable compound does not constitute an end of the structure but is set in a chained polymer. The radical polymerizable compound having a functional group is present in a main chain of a polymer in which cross-linking is formed by polymerization with a radical polymerizable monomer having at least three functional groups or a cross-linking chain between main chains. There are two kinds of the cross-linking chains. One is the cross-linking chain between a polymer and another polymer, and the other is the cross-linking chain formed by cross-linking a portion in the main chain present in a folded state in a polymer with a moiety deriving from a monomer polymerized away from the portion. Regardless of whether or not the radical polymerizable compound having a functional group with a charge transport structure is present in the main chain or in the cross-linking chain, the triaryl amine structure suspends from the chain portion. The triaryl amine structure has at least three aryl groups disposed in the radial directions relative to the nitrogen atom therein. Such a triaryl amine structure is bulky but does not directly joint with the chain portion and suspends from the chain portion via the carbonyl group, etc. That is, the triaryl amine structure is stereoscopically fixed in a flexible state. Therefore, these triaryl amine structures can be adjacent to each other with a moderate space in the polymer. Therefore, the structural distortion in the molecule is slight. In addition, the surface layer of a photoreceptor having such a structure is deduced to have an internal molecular structure with relatively few disconnections in the charge transport route.

In addition, the radical polymerizable compound having a charge transport structure imparts a charge transport power to the cross-linked surface layer, and the content ratio of the radical polymerizable compound having a charge transport structure is from 20 to 80% by weight, and preferably from 30 to 70% by weight based on the total weight of the cross linked surface layer. A content of the radical polymerizable compound having a charge transport structure that is excessively small tends not to sustain the charge transport power of the cross linked surface layer, which leads to deterioration of electric characteristics such as sensitivity, and a rise of residual voltage over repetitive use. A content of the radical polymerizable compound having a charge transport structure that is excessively large means reduction of the content of a monomer having three functional groups with no charge transport structure. This easily leads to reduction of the cross linking density, which inhibits demonstration of a high abrasion resistance. Desired electric characteristics and anti-abrasion property vary depending on the process used. Therefore, it is difficult to jump to any conclusion but considering the balance, the range of from 30 to 70% by weight is most preferred.

Monomer Other than Compound Having One Functional Group with Charge Transport Structure and Monomer Having at Least Three Functional Groups with No Charge Transport Structure The surface layer of the present invention is formed by polymerized cross-linked material of at least a charge generation compound, a radical polymerizable monomer having at least three functional groups with no charge transport structure and a radical polymerizable compound having a charge transport structure. In addition, a radical polymerizable monomer and an oligomer having one or two functional groups can be used in combination to control the viscosity during coating, relax the internal stress within the cross-linked surface layer, reduce the surface energy, decrease the friction coefficient, etc. Any known radical polymerizable monomers and oligomers can be used.

Specific examples of such radical monomers having one functional group include, but are not limited to, 2-ethyl hexyl acrylate, 2-hydroxy ethyl acrylate, 2-hydroxy propyl acrylate, tetrahydroflu frylacrylate, 2-ethylhexyl carbitol acrylate, 3-methoxy butyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, and a styrene monomer.

Specific examples of the radical polymerizable divalent functional groups include, but are not limited to, 1,3-butane diol acrylate, 1,4-butane diol acrylate, 1,9-butane diol dimethacrylate, 1,6-hexane diol diacrylate, 1,6-hexane diol dimethacrylate, diethylene glycol diacrylate, neopentyl glycol diacrylate, bisphenol A-EO modified diacrylate, bisphenol F-EO modified diacrylate, and neopentyl glycol diacrylate.

Specific examples of such functional monomers include, but are not limited to, a substitution product of, for example, octafluoro pentyl acrylate, 2-perfluoro octyl ethyl acrylate, 2-perfluoro octyl ethyl methacrylate, and 2-perfluoroisononyl ethyl acrylate, in which a fluorine atom is substituted; a siloxane repeating unit described in unexamined published Japanese patent applications Nos. (hereinafter referred to as JPP) H05-60503 and H06-45770; and a vinyl monomer, an acrylate or a methacrylate having a polysiloxane group such as acryloyl polydimethyl siloxane ethyl, methacryloyl polydimethyl siloxane ethyl, acryloyl polydimethyl siloxane propyl, acryloyl polydimethyl siloxane butyl, and diacryloyl polydimethyl siloxane diethyl.

Specific examples of the radical polymerizable oligomers include, but are not limited to, an epoxy acrylate based oligomer, a urethane acrylate based oligomer, and a polyester acrylate based oligomer.

However, an amount of the radical polymerizable monomer and/or the radical polymerizable oligomer having one or two functional groups that is excessively large tends to substantially decrease the density of three-dimensional cross-linking in the cross-linked surface layer, which leads to deterioration of the anti-abrasion property thereof. Therefore, the content of these monomer and oligomer is not greater than 50 parts, and preferably not greater than 30 parts based on 100 parts of the radical polymerizable monomer having at least three functional groups.

It is also preferable to reduce the density of sulfur in the radical polymerizable monomer and/or oligomers having one or two functional groups.

In addition, the surface layer of the present invention is preferably formed by curing at least a radical polymerizable monomer having at least three functional groups with no charge transport structure and a radical polymerizable compound with a charge transport structure with optical energy. A polymerization initiator is optionally used in the cross-linked surface layer to efficiently conduct the curing reaction.

Specific examples of photopolymerization initiators include, but are not limited to, an acetophenon based or ketal based photopolymerization initiators such as diethoxy acetophenone, 2,2-dimethoxy-1,2-diphenyl ethane-1-on, 1-hydroxy-cyclohexyl-phenyl-ketone, 4-(2-hydroxyethoxy) phenyl-(2-hydroxy-2-propyl) ketone, 2-benzyl-2-dimethylamino-1-(4-morpholinophenyl)butanone-1,2-hydroxy-2-methyl-1-phenyl propane-1-on, and 1-phenyl-1,2-propanedion-2-(o-ethoxycarbonyl)oxime; a benzoine ether based photopolymerization initiator such as benzoine, benzoine methyl ether, benzoine ethyl ether, benzoine isobutyl ether, and benzoine isopropyl ether; a benzophenone based photopolymerization initiator such as benzophenone, 4-hydroxy benzophenone, o-benzoyl methyl benzoate, 2-benzoyl naphthalene, 4-benzoyl biphenyl, 4-benzoyl phenyl ether, acrylizes benzophenone and 1,4-benzoyl benzene; a thioxanthone based photopolymerization initiator such as 2-isopropyl thioxanthone, 2-chlorothioxanthone, 2,4-dimethyl thioxanthone, 2,4-diethyl thioxanthone, and 2,4-dichloro thioxanthone; and other photopolymerization initiators such as ethyl anthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxybenzoyl)-2,4,4-trimethyl pentyl phosphine oxide, a methylphenyl glyoxy ester, 9,10-phenanthrene, an acridine based compound, a triadine based compound and an imidazole based compound. In addition, a compound having an acceleration effect on photopolymerization can be used alone or in combination with the photopolymerization initiator.

Specific examples of such compounds include, but are not limited to, triethanol amine, methyl diethanol amine, 4-dimethyl amino ethyl benzoate, 4-dimethyl amino isoamyl benzoate, ethyl benzoate (2-dimethyl amino), and 4,4'-dimethyl amino benzophenone.

The content of such a polymerization initiator is from 0.5 to 40 parts by weight and preferably from 1 to 20 parts by weight based on 100 parts by weight of the compound having a radical polymerization property.

Furthermore, the liquid application for use in formation of the surface layer for use in the present invention optionally includes additives such as various kinds of plasticizers (for relaxing internal stress or improving adhesiveness), a leveling agent, a charge transport material having a low molecular weight having no radical reaction property. Known additives can be used as these additives. A typical resin such as dibutylphthalate and dioctyl phthalate can be used as the plasticizer. The content thereof is not greater than 20% by weight and preferably not greater than 10% based on the total solid portion of the liquid application.

Silicone oils such as dimethyl silicone oil, methyl phenyl silicone oil and a polymer or an oligomer having a perfluoroalkyl group in its side chain can be used as the leveling agent. The content thereof is suitably not greater than 3% by weight based on the total solid portion of the liquid application.

The cross-linked surface layer for use in the present invention is formed by coating and curing a liquid application containing at least a radical polymerizable monomer having at least three functional groups with no charge transport structure, and a radical polymerizable compound having a charge transport structure. When a liquid of radical polymerizable monomer is used, other components are possibly dissolved in the liquid before application of the liquid. Optionally, the liquid application is diluted by a suitable solvent before coating.

Specific examples of such solvents include, but are not limited to, an alcohol such as methanol, ethanol, propanol and butanol; a ketone such as acetone, methyl ethyl ketone, methyl isobutyl ketone, and cycle hexanone; an ester such as ethyl acetate and butyl acetate; an ether such as tetrahydrofuran dioxane and propyl ether; a halogen based solvent such as dichloromethane, dichloroethane, trichloroethane and chlorobenzene; an aromatic series based solvent such as benzene, toluene and xylene; and a cellosolve based solvent such as methyl cellosolve, ethyl cellosolve and cellosolve acetate. These solvents can be used alone or in combination. The dilution ratio by using such a solvent is arbitrary and varies depending on the solubility of a composition, a coating method, and a target layer thickness. A dip coating method, a spray coating method, a bead coating method, a ring coating method, etc., can be used in application of the liquid application.

The surface layer of the photoreceptor of the present invention is formed by application of the liquid application described above followed by curing with an external photoenergy.

When curing with the photoenergy, the oxygen density is preferably reduced under 20%, and preferably from 0.001 to 2.0% The oxygen density is about 2.1% in atmosphere. Therefore, the air in the photoenergy irradiation tank is replaced by introducing gases such as nitrogen, helium, and argon.

A layer having a high surface smoothness with a large cross linking density is formed by maintaining an atmosphere having a low oxygen density of 20% or less during irradiation of photoenergy by the gas replacement. A relatively suitable layer can be also formed even with a low amount of irradiation.

Containing a bulky charge transport structure in the cross linked surface layer to maintain the electric characteristics, and increasing the density of the cross linking bonding to improve the durability are suitable for the cross linked surface layer of the present invention. When curing is performed rapidly upon application of an extremely high energy from outside subsequent to the coating of a liquid application of a cross-linked surface layer, curing proceeds unevenly so that the surface of the cross-linked surface layer is made rough. Therefore, using eternal energy such as optical energy is preferable because such energy can control the reaction speed according to the irradiation intensity condition, and the amount of the polymerization initiator.

An illustrative method of application of formation material of the cross linked surface layer for use in the present invention is described below. For example, when an acrylate monomer having three acryloyloxy groups and a triaryl amine compound having one acryloyloxy group are used as a liquid application, the content ratio of the acrylate monomer to the triaryl amine is 3/7 to 7/3 and an polymerization initiator is added in an amount of 3 to 20% by weight based on the total amount of the acrylate compound followed by an addition of a solvent to prepare the liquid application. For example, when a triaryl amine based donor as the charge transport material and polycarbonate as the binder resin are used in a charge transport layer provided under the cross-linked surface layer and the cross linked surface layer is formed by a spray application method, tetrahydrofuran, 2-butanone or ethyl acetate are preferably used as the solvent mentioned above for the liquid application. Its content is 3 to 10 times as much as the total weight of the acrylate compound.

Next, for example, the liquid application prepared as described above is applied with, for example, a spray, on a photoreceptor formed by sequentially accumulating an undercoating layer, a charge generation layer, and a charge transport layer in this order on a substrate such as an aluminum cylinder. Subsequent to drying the liquid application at a relatively low temperature (25 to 80° C.) for a short time (1 to 10 minutes), the liquid application is cured upon application of optical energy irradiation or heat.

A pressurized mercury lamp, a metal halide lamp, etc., is used as the light source with a preferable illumination intensity of from 50 to 300 mW/cm365. For example, the entire surface of the photoreceptor can be uniformly irradiated with UV light having an illumination intensity of 600 mW/cm$^2$ for curing for about 45 seconds while rotating the drum. Thereby, abrasion resistance, durability, and electric characteristics of the thus obtained photoreceptor become all the more suitable.

Subsequent to completion of the curing reaction, the surface layer is heated at 100° C. to 150° C. for 10 to 30 minutes to reduce the amount of remaining solvent and stabilize the surface layer. As a result, the photoreceptor of the present invention is manufactured.

The present invention is described in detail below with reference to the layer structure.

Layer Structure of Photoreceptor

The photoreceptor of the present invention is described with reference to the accompanying drawings.

FIG. 1 is a diagram illustrating a cross section of the photoreceptor of the present invention. The photoreceptor is of a single layered structure in which a photosensitive layer 33 having a charge generation function and a charge transport layer function simultaneously is provided on an electroconductive substrate 31.

Figure 2:
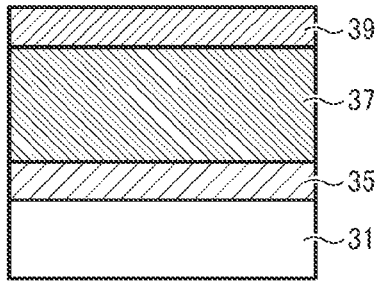
FIG. 2 is a diagram illustrating a cross section of another example of the photoreceptor of the present invention.

FIG. 2 is a diagram illustrating a photoreceptor of a laminate structure in which a photosensitive layer formed of a charge generation layer 35 having a charge generation function and a charge transport layer 37 having a charge transport function is accumulated on the electroconductive substrate 31.

Electroconductive Substrate

The electroconductive substrate 31 can be formed by using material having a volume resistance of not greater than $10^{10}$ Ω·cm. For example, there can be used plastic or paper having a film form or cylindrical form covered with metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Furthermore, a tube which is manufactured from the board mentioned above by a crafting technique such as extruding and extracting and surface-treatment such as cutting, super finishing and grinding is also usable.

In addition, an endless nickel belt and an endless stainless belt described in JPP S52-36016 can be used as the electroconductive substrate.

An electroconductive substrate formed by applying to the substrate mentioned above a liquid application in which electroconductive powder is dispersed in a suitable binder resin can be used as the electroconductive substrate for use in the present invention.

Specific examples of such electroconductive powders include, but are not limited to, carbon black, acetylene black, metal powder, such as powder of aluminum, nickel, iron, nichrome, copper, zinc and silver, and metal oxide powder, such as electroconductive tin oxide powder and ITO powder. Specific examples of the binder resins which are used together with the electroconductive powder include, but are not limited to, thermoplastic resins, thermosetting resins, and optical curing resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin. Such an electroconductive layer can be formed by dispersing the electroconductive powder and the binder resins mentioned above in a suitable solvent, for example, tetrahydrofuran (THF), dichloromethane (MDC), methyl ethyl ketone (MEK), and toluene and applying the resultant to an electroconductive substrate.

In addition, an electroconductive substrate formed by providing a heat contraction tube as an electroconductive layer on a suitable cylindrical substrate can be used as the electroconductive substrate in the present invention. The heat contraction tube is formed of material such as polyvinyl chloride, polypropylene, polyester, polystyrene, polyvinylidene chloride, polyethylene, chloride rubber, and TEFLON®, which includes the electroconductive powder mentioned above.

Photosensitive Layer

Next, the photosensitive layer is described.

The photosensitive layer employs a single layer structure or a laminate structure.

The photosensitive layer employing a laminate structure is formed of a charge generation layer having a charge generation function and a charge transport layer having a charge transport function.

The photosensitive layer employing a single layered structure has a charge generation function and a charge transport function at the same time.

The photosensitive layer of a laminate structure and the photosensitive layer of a single layered structure are described separately below.

Photosensitive Layer of Laminate Structure Charge Generation Layer

The charge generation layer 35 is a layer mainly formed of charge generation material having a charge generation function and an optional binder resin. Inorganic material and organic material can be used as the charge generation material.

Specific examples of the inorganic materials include, but are not limited to, crystal selenium, amorphous-selenium, selenium-tellurium-halogen, selenium-arsenic compounds, and amorphous-silicon. With regard to the amorphous-silicon, those in which a dangling-bond is terminated with a hydrogen atom or a halogen atom, and those in which boron atoms or phosphorous atoms are doped are preferably used.

As for the organic material, any known material in the art can be used.

Phthalocyanine pigments, for example, metal phthalocyanine and metal-free phthalocyanine; azulenium salt pigments; squaric acid methine pigments; azo pigments having a carbazole skeleton; azo pigments having a triphenylamine skeleton; azo pigments having a diphenylamine skeleton; azo pigments having a dibenzothiophene skeleton; azo pigments having a fluorenone skeleton; azo pigments having an oxadiazole skeleton; azo pigments having a bis-stilbene skeleton; azo pigments having a distilyloxadiazole skeleton; azo pigments having a distylylcarbazole skeleton; perylene pigments, anthraquinone or polycyclic quinone pigments; quinoneimine pigments; diphenylmethane and triphenylmethane pigments; benzoquinone and naphthoquinone pigments; cyanine and azomethine pigments, indigoid pigments, and bis-benzimidazole pigments.

Among these, phthalocyanines are particularly preferably used. Among these, titanyl phthlocyanines are more preferable. Among these, titanly phthalocyanine having a crystal form having a CuKα X ray diffraction spectrum such that a maximum diffraction peak is observed at least a Bragg (2θ) angle of 9.6±0.2°, 24.0±0.2° and 27.2±0.2° is a highly sensitive material in particular.

These charge generation materials may be used alone or in combination.

Specific examples of the binder resin optionally used in the charge generation layer include, but are not limited to, polyamides, polyurethanes, epoxy resins, polyketones, polycarbonates, silicone resins, acrylic resins, polyvinylbutyrals, polyvinylformals, polyvinylketones, polystyrenes, poly-N-vinylcarbazoles, and polyacrylamides. These binder resins may be used alone or may be used as a mixture of two or more.

In addition to the binder resins specified above for the charge generation layer, polymerizable charge transport material having a charge transport function, for example, a polycarbonate resin, a polyester resin, a polyurethane resin, a polyether resin, a polysiloxane resin or an acrylic resin having an arylamine skeleton, a benzidine skeleton, a hydrazone skeleton, a carbazole skeleton, a stilbene skeleton or a pyrazoline skeleton; and polymerizable material having a polysilane skeleton, can be also used.

The charge generation layer optionally contains charge transport material having a low molecular weight.

The charge transport material having a low molecular weight which can be used in combination in the charge generation layer is classified into positive hole transport material and electron transport material.

Specific examples of such electron transport material include, but are not limited to, electron acceptance material such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, and diphenoquinone, derivatives.

These charge transport material can be used alone or in combination.

The following electron donating material can be suitably used as the positive hole transport material.

Specific examples of such positive hole transport material include, but are not limited to, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives and other known materials. These positive hole transport materials can be used alone or in combination.

The charge generation layer is typically manufactured by a vacuum thin layer formation method or a casting method using a liquid dispersion system.

Specific examples of the vacuum thin layer formation methods include, but are not limited to, a vacuum evaporation method, a glow discharge decomposition method, an ion-plating method, a sputtering method, a reactive sputtering method, or a CVD method. The inorganic material and organic material specified above can be suitably used in these methods.

In the casting method, the above-mentioned inorganic or organic charge generation material is dispersed with an optional binder resin in a solvent, for example, tetrahydrofuran, dioxane, dioxsolan, toluene, dichloromethane, monochlorobenzene, dichloroethane, cyclohexanone, cyclopentanone, anisole, xylene, methylethylketone, acetone, ethylacetate, butylacetate using, for example, a ball mill, an attritor, a sand mill, or a beadmill. Thereafter, suitably diluted liquid dispersion is applied to the surface of the electroconductive substrate to form the charge generation layer. Leveling agents such as dimethyl silicone oil, and methylphenyl silicone oil, can be optionally added. A dip coating method, a spray coating method, a bead coating method, a ring coating method, etc., can be used in application of the liquid application.

The thickness of the thus provided charge generation layer is suitably from 0.01 to 5 μm and preferably from 0.05 to 2 μm.

Charge Transport Layer

The charge generation layer 37 has a charge transport function and a surface layer is formed thereon.

The charge transport layer is formed by dissolving and dispersing a charge transport material having a charge transport function, a binder resin, a radical polymerizable compound having at least three functional groups with no charge transport structure, and a radical polymerizable compound with a charge transport structure in a suitable solvent, and applying the obtained liquid to the charge generation layer followed by drying. Thereafter, a liquid application of the radical polymerizable components and an optional filler is applied and cured and cross-linked by application of an external energy.

The thickness of the thus obtained charge transport layer is suitably from about 5 to about 90 μm and preferably from about 10 to about 30 μm.

The electron transport materials; the positive hole transport materials and the charge transport polymer mentioned above in the description about the charge generation layer can be used as the charge transport material.

Specific examples of the binder resin include, but are not limited to, thermoplastic resins or thermocuring resins, for example, polystyrene, copolymers of styrene and acrylonitrile, copolymers of styrene and butadiene, copolymers of styrene and maleic anhydrate, polyesters, polyvinyl chlorides, copolymers of a vinyl chloride and a vinyl acetate, polyvinyl acetates, polyvinylidene chloride, polyarylate resins, phenoxy resins, polycarbonate reins, cellulose acetate resins, ethyl cellulose resins, polyvinyl butyral, polyvinyl formal, polyvinyl toluene, poly-N-vinylcarbozole, acrylic resin, silicone resins, epoxy resins, melamine resins, urethane resins, phenol resins, and alkyd resins.

In the present invention, a radical polymerizable compound having at least three functional groups with no charge transport structure, and a radical polymerizable compound with a charge transport structure are added to the charge transport layer to improve the adhesiveness between the charge transport layer and the surface layer.

The radical polymerizable compound having at least three functional groups with no charge transport structure, and the radical polymerizable compound with a charge transport structure specified for the surface layer can be used in the charge transport layer.

The content of the charge transport material in the charge transport layer is from 20 to 300 parts by weight and preferably from 40 to 150 parts by weight based on 100 parts by weight of the binder resin.

The same solvent specified for the charge generation layer can be used as the solvent for use in application of the charge transport layer. The solvent that suitably dissolve the charge transport material and the binder resin is suitable.

These solvents can be used alone or in combination. In addition, the same method as in the case of the charge generation layer can be used to form the charge transport layer.

In addition, a plasticizing agent and/or a leveling agent can be added, if desired.

Specific examples of the plasticizing agent for use in the charge transport layer include known resins such as dibutyl phthalate and dioctyl phthalate. The addition amount of the plasticizing agent is preferably from 0 to 30 parts by weight based on 100 parts by weight of the binder resin.

Specific examples of the leveling agent for use in the charge transport layer include, but are not limited to, silicone oils, for example, dimethyl silicone oil and methyl phenyl silicone oil, and polymers or oligomers having perfluoroalkyl groups in its side chain. The addition amount of the leveling agent is preferably from 0 to 1 part by weight based on 100 parts by weight of the binder resin.

As described in the method of manufacturing the surface layer, a liquid application containing the radical polymerizable component for use in the present invention is applied to the charge transport layer. Subsequent to optional drying, an external energy such as heat and light starts curing reaction to form a surface layer.

The thus formed surface layer has a thickness of from 1 to 20 μm and preferably from 2 to 10 μm.

When the surface layer is too thin, the durability thereof tend to be not stable due to the variation of the layer thickness. When the surface layer is too thick, the charge transport layer tends to be thick as a whole, which causes deterioration of image reproducibility due to diffusion of charges.

Photosensitive Layer of Single Layered Structure

The photosensitive layer of a single layered structure has a charge generation function and a charge transport layer simultaneously and a surface layer is formed on the photosensitive layer in the present invention.

The photosensitive layer 33 is formed by dissolving and/or dispersing a charge generation material having a charge generation function, a charge transport material having a charge transport function, and a binder resin in a suitable solvent followed by application and drying.

In addition, a plasticizing agent and/or a leveling agent can be added, if desired.

The respective descriptions about the dispersion method of the charge generation material, the charge generation material, the charge transport material, a plasticizer and a leveling agent for the charge generation layer and the charge transport layer are all true for the photosensitive layer 33.

The binder resin specified for the charge transport layer and a mixture of the binder resin with the binder resin specified in the charge generation layer can be used.

The thickness of the thus obtained photosensitive layer is suitably from about 5 to about 30 μm and preferably from about 10 to about 25 μm.

As described above, a liquid application containing the radical polymerizable component in the present invention and the charge generation material is applied to the photosensitive layer and optionally dried. Thereafter, the surface layer is cured upon an external energy such as heat and light to form a surface layer.

The thus formed surface layer has a thickness of from 1 to 20 μm and preferably from 2 to 10 μm.

When the surface layer is too thin, the durability thereof tend to be not stable due to the variation of the layer thickness.

The contents of the charge generation material, the binder resin, and the charge transport layer contained in the photosensitive layer of a single layered structure are preferably from 1 to 30% by weight, 20 to 80% by weight, and 10 to 70% by weight, respectively, based on the total amount of the photosensitive layer.

Undercoating Layer

In the image bearing member of the present invention, an undercoating layer can be provided between the electroconductive substrate and the photosensitive layer. Typically, such an undercoating layer is mainly made of a resin. Considering that a photosensitive layer is applied to such an undercoating layer (i.e., resin) in a form of solvent, the resin is preferably hardly soluble in a known organic solvent. Specific examples of such resins include, but are not limited to, water soluble resins, such as polyvinyl alcohol, casein, and sodium polyacrylate, alcohol soluble resins, such as copolymerized nylon and methoxymethylized nylon and curing resins which form a three dimension mesh structure, such as polyurethane, melamine resins, phenol resins, alkyd-melamine resins and epoxy resins. In addition, fine powder pigments of metal oxide, such as titanium oxides, silica, alumina, zirconium oxides, tin oxides and indium oxides can be added to the undercoating layer to prevent moiré and reduce the residual voltage.

The undercoating layer described above can be formed by using a suitable solvent and a suitable coating method as described for the photosensitive layer.

Silane coupling agents, titanium coupling agents and chromium coupling agents can be used in the undercoating layer.

Furthermore, the undercoating layer can be formed by using a material formed by anodizing $Al_2O_3$, or an organic compound, such as polyparaxylylene (parylene) or an inorganic compound, such as $SiO_2$, $SnO_2$, $TiO_2$, ITO, and $CeO_2$ by a vacuum thin-film forming method. Any other known methods can be also available.

The layer thickness of the undercoating layer is suitably from 0 to 5 μm.

Addition of Anti-Oxidizing Agent to Each Layer

Furthermore, in the present invention, an anti-oxidizing agent can be added to each layer, i.e., the surface layer, the charge generation layer, the charge transport layer, the undercoating layer, to improve the environmental resistance, in particular, to prevent the degradation of sensitivity and the rise in residual potential.

Specific examples of the anti-oxidizing agent include, but are not limited to, the following:

Phenol Compounds 2,6-di-t-butyl-p-cresol, butylated hydroxyanisol, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, and tocopherols.

Paraphenylene Diamines

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Hydroquinones 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Organic Phosphorous Compounds triphenyl phosphine, tri(nonylphenyl)phosphine, tri(di-nonylphenyl)phosphine, tricresyl phosphine, and tri(2,4-dibutylphenoxy)phosphine.

These compounds are known as anti-oxidants for rubber, plastic, and oils and marketed products thereof can easily be obtained.

The addition amount of the anti-oxidizing agent is preferably 0.01 to 10 parts by weight based on the total weight of the layer to which the anti-oxidizing agent is added.

Image Formation Method and Image Forming Apparatus

The image formation method and the image forming apparatus of the present invention are described next with reference to the accompanying drawings.

The image formation method and the image forming apparatus of the present invention use a photoreceptor having a smooth charge transport surface layer. The image formation method and the image forming apparatus include, but are not limited to, processes or devices of: charging the photoreceptor; irradiating the photoreceptor with light to form a latent electrostatic image; developing the latent image with toner; transferring the toner image to an image carrying body (transfer medium); fixing the toner image; and cleaning the surface of the photoreceptor.

The processes described above are not necessarily applied to the image formation method in which a latent electrostatic image is directly transferred to a transfer body followed by development process.

Figure 3:
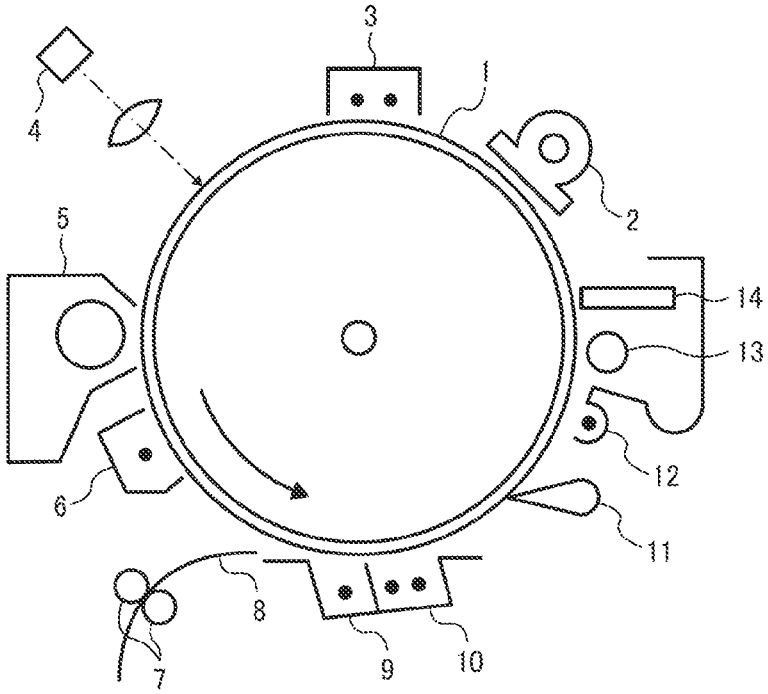
FIG. 3 is a schematic diagram illustrating an example of the image forming apparatus of the present invention.

FIG. 3 is a schematic diagram illustrating an example of the image forming apparatus.

A charging device 3 is used as a device to uniformly charge a photoreceptor 1.

Specific examples of the charging device 3 include, but are not limited to, a corotron device, a scorotron device, a solid discharging element, a needle electrode device, a roller charger, and an electroconductive brush device, and any known method can be used.

Next, an image irradiation unit 4 irradiates the uniformly charged photoreceptor 1 to form a latent electrostatic image thereon.

Typical illuminating materials, for example, a fluorescent lamp, a tungsten lamp, a halogen lamp, a mercury lamp, a sodium lamp, a light emitting diode (LED), a semiconductor laser (LD), and electroluminescence (EL) can be used as the light source of the image irradiation unit 4.

Various kinds of optical filters, for example, a sharp cut filter, a band-pass filter, a near infrared filter, a dichroic filter, a coherent filter and a color conversion filter, can be used to irradiate an image bearing member with light having only a particular wavelength.

A development unit 5 is used to visualize the latent electrostatic image formed on the photoreceptor 1.

As the development method, there are a one-component developing method and a two-component development method using a dry toner, and a wet-developing method using a wet toner.

When the photoreceptor 1 is positively (or negatively) charged and irradiated, a positive (or negative) latent electrostatic image is formed on the photoreceptor 1.

When the latent electrostatic image is developed with a negatively (or positively) charged toner (volt-detecting fine particles), a positive image is formed. When the latent electrostatic image is developed using a positively (or negatively) charged toner, a negative image is formed.

Next, a transfer charger 9 is used to transfer the visualized toner image on the photoreceptor 1 to a transfer medium 8.

A pre-transfer charging device 6 can be used to improve the image transfer.

An electrostatic transfer system using a transfer charger or a bias roller, a mechanical transfer system using an adhesive transfer method, a pressure transfer method, etc., and a magnetic transfer system can be used. The charging device described above can be used in the electrostatic transfer system. The reference numeral 7 represents a pair of sheet feeding rollers.

Next, a separation charging device 10 and a separation claw 11 are used to separate the transfer medium 8 from the photoreceptor 1. Other separation methods that can be used are, for example, electrostatic sucking induction separation, side edge belt separation, front edge grip conveyance and curvature separation. The charging device described above can be used as the separation charging device 12.

Next, the toner remaining on the photoreceptor 1 after image transfer is removed by a fur brush 13 and a cleaning blade 14. A pre-cleaning charging device 12 can be used for efficient cleaning performance. There are a web system and a magnet brush system as the other cleaning methods. These systems can be employed alone or in combination.

A discharging unit can be optionally used to remove the latent electrostatic image on the photoreceptor 1. As the discharging unit, a discharging lamp 2 or a discharging charging device can be used. The irradiation light source and the charging device mentioned above can be used.

In addition, with regard to the processes that are performed not in the vicinity of the photoreceptor 1, i.e., reading an original, sheet-feeding, fixing, and paper-discharging, known devices and methods in the art can be used. The present invention provides the image forming apparatus and the image formation method that use the photoreceptor of the present invention in the image formation unit as described above.

Figure 4:
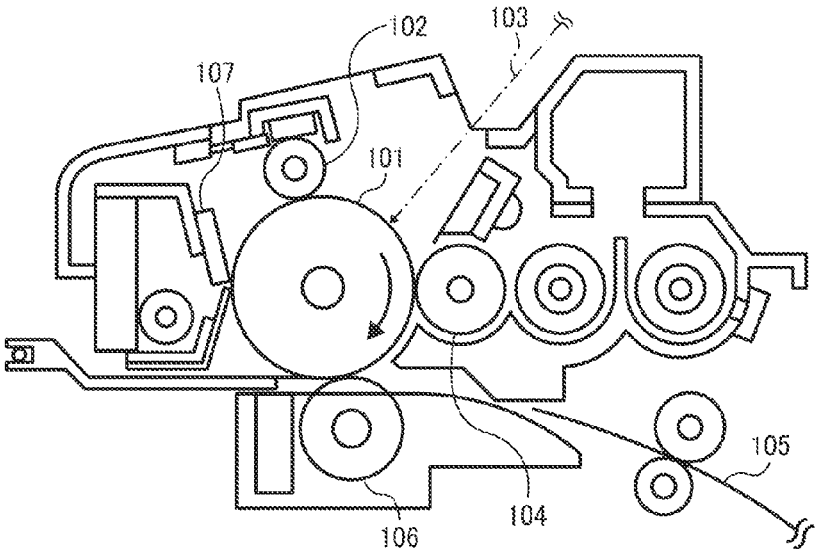
FIG. 4 is a schematic diagram illustrating an example of the process cartridge for use in the image forming apparatus of the present invention.

The image formation unit may be fixed in and incorporated into a photocopier, a facsimile machine, or a printer, or may be detachably attachable to such devices in a form of a process cartridge. FIG. 4 is a diagram illustrating an example of the process cartridge.

The process cartridge for use in an image forming apparatus is a device (or component) that integrates a photoreceptor (image bearing member) 101 therein, includes at least one device selected from a charging device 102, a development device 104, a transfer device 106, a cleaning device 107 and a discharging device (not shown) and is detachably mounted in the main part of an image forming apparatus.

The image formation process by the apparatus illustrated in FIG. 4 is described next. While the photoreceptor 101 rotates in the direction indicated by an arrow in FIG. 5, a latent electrostatic image corresponding to the exposure image is formed on the surface of the photoreceptor 101 through charging and irradiating the surface thereof by the charging device 102 and an irradiation device 103. This latent electrostatic image is developed with toner by the development device 104, and the toner image is transferred to a transferring medium 105 by the transfer device 106.

Then, the surface of the photoreceptor 101 is cleaned after the image transfer by a cleaning device 107 and discharged by a discharging device (not shown) to be ready for the next image formation cycle.

The present invention provides the process cartridge for use in image formation which includes the photoreceptor having a surface layer integrated with at least one of the charging device, the development device, the transfer device, the cleaning device and the discharging device.

As seen in the description above, the photoreceptor of the present invention can be used not only in an electrophotographic photocopier but also in an applied electrophotography field, for example, a laser beam printer, a CRT printer, an LED printer, a liquid crystal printer and a laser printing.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Example of Compound Having Charge Transport Structure

The compound having a charge transport structure for use in the present invention can be synthesized by, for example, the method described in Japanese patent No. (hereinafter referred to as JP) 3164426.

A specific example is described below.

(1) Hydroxyl Group Substituted Triarylamine Compound (Represented by the Following Chemical Structure B)

240 ml of sulfolane are added to 113.85 g (0.3 mol) of methoxy group substituted triaryl amine compound represented by the Chemical structure A and 138 g (0.92 mol) of sodium iodide. The mixture is heated to 60° C. in nitrogen air stream. 99 g (0.91 mol) of trimethylchlorosilane is dropped to the resultant solution in one hour. Thereafter, the solution is stirred for 4.5 hours at around 60° C. and the reaction is terminated. About 1.5 litter of toluene is added to the reaction liquid. Subsequent to cooling down to room temperature, the liquid is repeatedly washed with water and sodium carbide aqueous solution. Then, the solvent is removed from the toluene solution, and the solution is purified by column chromatography (absorption medium: silica gel; developing solvent: toluene:ethyl acetate=20:1). Cyclohexane is added to the obtained light yellow oil to precipitate crystal. 88.1 parts (yield ratio=80.4%) of the white crystal represented by the following Chemical structure B is thus obtained. Melting point: 64.0-66.0 degree C.

TABLE 1

| Element Analysis Value (%) | | | |
|---|---|---|---|
| | C | H | N |
| Measured value | 85.06 | 6.41 | 3.73 |
| Calculated value | 85.44 | 6.34 | 3.83 |

Chemical structure A

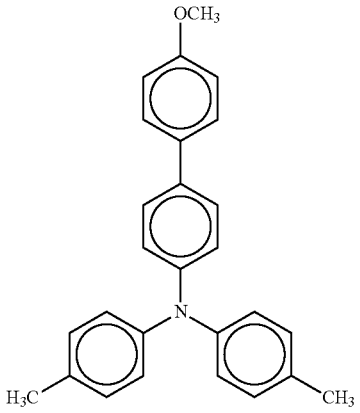

Chemical structure B

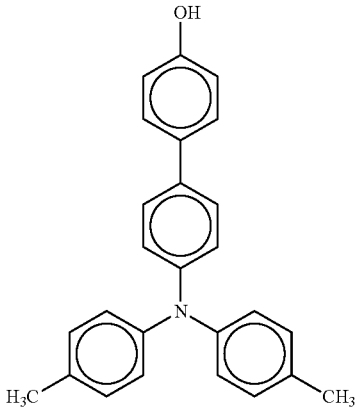

(2) Triaryl Amino Group Substituted Acrylate Compound 82.9 g (0.227 mol) of the hydroxyl group substituted triaryl amine compound (Chemical structure B) obtained in (1) is dissolved in 400 ml of tetrahydrofuran and sodium hydroxide aqueous solution (NaOH: 12.4 g, water: 100 ml) is dropped thereto. The solution is cooled down to 5° C. and 25.2 parts (0.272 mol) of chloride acrylate is dropped thereto in 40 minutes. Thereafter, the solution is stirred for 3 hours at 5° C., and the reaction is terminated. The resultant reaction liquid is poured to water and extracted by toluene. The extracted liquid is repeatedly washed with sodium acid carbonate and water. Thereafter, the solvent is removed from the toluene solution, and the solution is purified by column chromatography (absorption medium: silica gel; developing solvent: toluene).

n-hexane is added to the obtained colorless oil to precipitate crystal. 80.73 g (yield ratio: 84.8%) of white crystal of the Illustrated Chemical Compound No. 54 is thus obtained.

Melting point: 117.5-119.0 degree C.

TABLE 2

| Element Analysis Value (%) | | | |
|---|---|---|---|
| | C | H | N |
| Measured value | 83.13 | 6.01 | 3.16 |
| Calculated value | 83.02 | 6.00 | 3.33 |

A specific synthesis example of titanylphthalocyanine pigment is described.

Synthesis Example of Titanylphthalocyanine Pigment 292 g of 1,3-diiminoisoindoline and 2,000 ml of sulfolane are mixed and 204 g of titanium tetrabutoxido is dropped thereto in nitrogen atmosphere. Thereafter, the temperature is raised to 180° C., and the resultant is stirred to conduct reaction for 5 hours while the reaction temperature is maintained in a range of from 170 to 180° C. After the reaction is complete, the resultant is naturally cooled down and the precipitation is filtered. The filtered resultant is washed with chloroform until the obtained powder indicates the color of blue. Next, the resultant powder is washed with methanol several times. Further, the resultant is washed with hot water of 80° C. several times and dried to obtain a coarse titanyl phthalocyanine. The coarse titanyl phthalocyanine is dissolved in strong sulfuric acid the amount of which was 20 times as much as that of the titanyl phthalocyanine. The resultant is dropped to iced water the amount of which was 100 times as much as the resultant. The precipitated crystal is filtrated and washed with water repeatedly until the washing water indicates neutral (a pH of 7.0). Thus, a wet cake (water paste) of titanyl phthalocyanine pigment. The obtained wet cake is washed thoroughly with deionized water. 20 g of the thus obtained wet cake is put in 200 g of 1,2-dichloroethane and stirred for 4 hours. 1,000 g of methanol is added. Subsequent to one hour stirring, the resultant is filtered and dried to obtain titanyl phthalocyanine powder (referred to as Pigment 1).

X ray diffraction spectrum is measured for the obtained powder under the following conditions.

X ray tube: Cu

Voltage: 40 kV

Current: 20 mA

Scanning speed: 1°/minute

Scanning area: 3 to 40°

Time constant: 2 seconds

Figure 5:
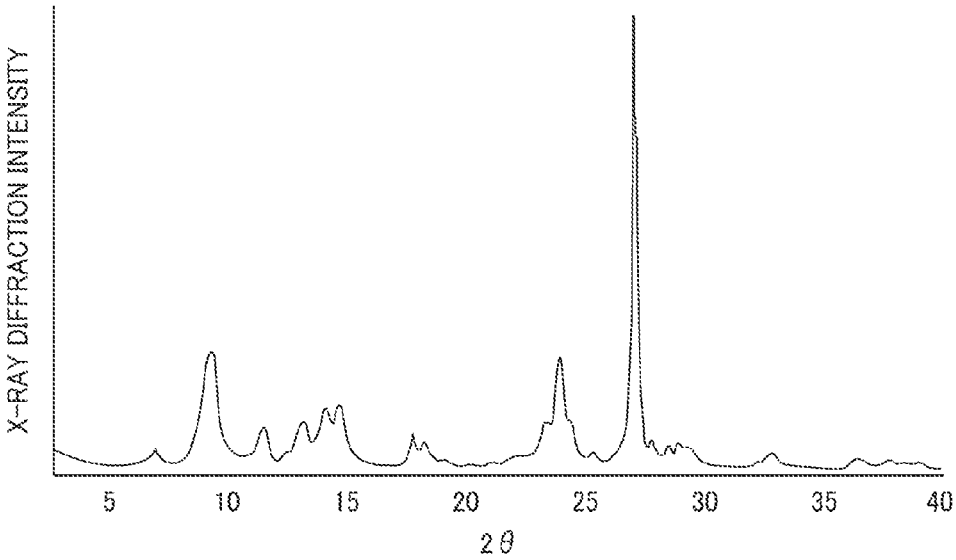
FIG. 5 is a diagram illustrating an X-ray spectrum of the titanylphthalocyanine obtained in the synthesis example described later.

FIG. 5 is a diagram illustrating the X-ray spectrum of the titanylphthalocyanine obtained in the synthesis example. According to the X ray diffraction spectrum, the obtained titanyl phthalocyanine pigment is found to have a crystal type of having the main peaks at a Bragg (2θ) angle of 9.6±0.2°, 24.0±20°, and 27.2±0.2°.

A specific refinement example of the radical polymerizable monomer having at least 3 functional groups with no charge transport structure is described next.

Refinement Example

Separation Refinement Method According to Column Chromatography

Column: phai 100 mm×960 mm

Filler: silica gel (Wakogel C300, manufactured by Wako Pure Chemical Industries, Ltd.)

Developing solvent: n-hexane/ethyl acetate=3/1

Collect fractions including a target as simple substance and condense them to extract refinement matter of the radical polymerizable monomer.

Absorption Refinement Method by Absorbent

Add 10 g of absorbent against 100 g of a radical polymerizable monomer followed by one hour stirring. Thereafter, subsequent to filtration, refinement matter of the radical polymerizable monomer is extracted. 10 g of the absorbent is repeatedly added to start this absorption refinement treatment again followed by one hour stirring and extract refined radical polymerizable monomer.

Next, the method of measuring sulfur concentration and Ames test to check the content ratio of sulfur in a sulfur-based catalyst are described.

Measuring Density of Sulfur (Combustion Decomposition-Ion Chromatography)

Automatic combustion instrument: AQF-100 (manufactured by Mitsubishi Chemical Analytech Co., Ltd.)

Electric furnace temperature: Inlet 900 degree C., outlet 1,000 degree C.

Flow amount of gas: Argon 200 ml/min, oxygen 400 ml/min.

Liquid absorption: 10 ml

Sample amount: 9 to 12 mg

Ion chromatograph: ICS-1500 (manufactured by Dionex Corporation)

Mobile phase 2.7 mmol/L $Na_2CO_3$, 0.3 mmol/L $NaHCO_3$

Flow speed: 1.5 ml/min.

Detection unit: Electric conductivity detector

Infusion amount: 100 micro litter

Mutation Test (Ames Test)

A mutation test (Ames test) is employed to check the safety in the present invention.

A plate method is adopted as the test method in the present invention.

TA1535 is used as the strain and the test is conducted under the condition of metabolic activity.

Add 250 mg of dimethylsulfoxide (DIMSO) to 250 mg of a radical polymerizable monomer having at least 3 functional groups with no charge transport structure followed by ultrasonic treatment for one minute to prepare a clear solution for the test.

5 kinds of densities (625 micro gram/plate, 1,250 micro gram/plate, 2,500 micro gram/plate, 5,000 micro gram/plate, and 10,000 micro gram/plate) of the radical polymerizable monomer having at least 3 functional groups with no charge transport structure are used. Among these, the quotient (referred to as "colony increase multiple" in the present invention) obtained by dividing the maximum number of the colonies with the number of colonies in the control solvent is used for comparison. The smaller the quotient, the safer the test sample. The result of the safety is determined as negative for a quotient of 20 or below.

Example 1

Liquid application having the following recipe is applied to an aluminum substrate (outer diameter: 100 mm ϕ) by a dip coating method to form an undercoating layer having a layer thickness of 4.0 μm after drying.

| Liquid Application for Undercoating Layer | |
|---|---|
| Alkyd resin (Beckozole 307-60-EL, manufactured by Dainippon Ink and Chemicals, Inc.; Solid portion: 50%) | 6.5 parts |

-continued

| Liquid Application for Undercoating Layer | |
|---|---|
| Melamine resin (Super-beckamine G-821-60, manufactured by Dainippon Ink and Chemicals, Inc.) | 3.5 parts |
| Titanium oxide (CR-El, manufactured by Ishiahara Sangyo Kaisha Ltd.) | 60 parts |
| Methylethylketone | 90 parts |

Liquid application for charge generation layer containing the titanyl phthalocyanine pigment is applied to the undercoating layer by a dip coating followed by heating and drying to form a charge generation layer having a layer thickness of 0.3 μm.

| Liquid Application for Charge Generation Layer | |
|---|---|
| Titanyl phtahlocyanine pigment manufactured by Synthesis Example 1 | 2.5 parts |
| Polyvinylbutyral (BX-1, manufactured by Sekisui Chemical Co., Ltd.) | 0.5 parts |
| Methylethylketone | 100 parts |

Liquid application for charge transport layer containing the following materials is applied to the charge generation layer by a dip coating followed by heating and drying to form a charge transport layer having a layer thickness of 20 μm.

| Liquid Application for Charge Transport Layer | |
|---|---|
| Bisphenol Z type polycarbonate | 9 parts |
| Charge transport compound represented by the following chemical formula 5 | 9 parts |

Chemical formula 5

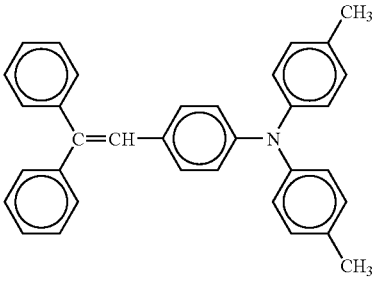

The liquid application of a surface layer having the following recipe is spray-coated on the charge transport layer. A photoreceptor drum is installed in an optical energy irradiation tank and irradiated with light.

Ultraviolet irradiator (manufactured by Fusion Co., Ltd) including an H valve having a strong emission energy in the range of from 200 to 280 nm as the light source is used to irradiate the drum under the conditions of input voltage of 240 mW/cm$^2$, and irradiation time of 180 sec. followed by a 30 minute drying at 130 degree C. to obtain a photoreceptor having a surface layer with a thickness of 12 micro meter.

Grind down the surface layer in an amount of 1 mg and measure the sulfur concentration by the combustion decomposition-ion chromatography. The result is 30 ppmw.

Liquid Application for Surface Layer

The sulfur concentration of trimethylol propane triacrylate (TMPTA, Aronix M-309, manufactured by TOA GOSEI CO., LTD.) is measured and the result is 180 ppmw. This TMPTA is refined by the separation refinement method according to column chromatography. The sulfur concentration of the TMPTA refined by the column chromatography is measured according to the combustion decomposition-ion chromatography and the result is 20 ppmw. A mutation test is conducted for the TMPTA refined by the column chromatography and its colony increase multiple is 1.2.

| | |
|---|---|
| TMPTA refined by the separation refinement method according to the column chromatography | 10 parts |

Chemical formula 6

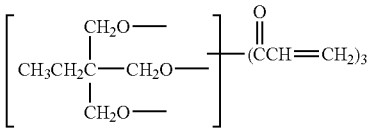

| | |
|---|---|
| Radical polymerizable compound having one functional group with a charge transport structure | 10 parts |

Chemical formula 7

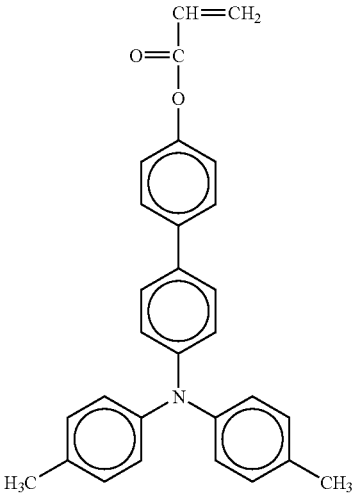

The sulfur concentration of the radical polymerizable compound having a charge transport structure is measured and the result is 5 ppmw.

| | |
|---|---|
| Photo polymerization initiator | 0.5 parts |

Chemical formula 8

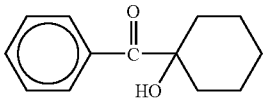

| | |
|---|---|
| Tetrahydrofuran | 80 parts |

Example 2

The liquid application of surface layer is prepared in the same manner as in Example 1 except that the radical polymerizable monomer having at least 3 functional groups with no charge transport structure for use in the liquid application of surface layer is replaced with a TMPTA (V#295, manufactured by Osaka Organic Chemical Industry Ltd.). The sulfur concentration contained in the TMPTA after refinement is 30 ppmw. The sulfur concentration remaining in the surface layer is 15 ppmw. A mutation test is conducted for the TMPTA refined by the column chromatography and its colony increase multiple is 1.1.

Example 3

The liquid application of surface layer is prepared in the same manner as in Example 1 except that the radical polymerizable monomer having at least 3 functional groups with no charge transport structure for use in the liquid application of surface layer is replaced with a TMPTA (kayarad, manufactured by Nipponn Kayaku Co., Ltd.) The sulfur concentration of the product prior to refinement is 310 ppmw. The sulfur concentration contained in the TMPTA after refinement is 30 ppmw. The sulfur concentration remaining in the surface layer is 20 ppmw. A mutation test is conducted for the TMPTA refined by the column chromatography and its colony increase multiple is 1.2.

Example 4

The liquid application of surface layer is prepared in the same manner as in Example 1 except that the radical polymerizable monomer having at least 3 functional groups with no charge transport structure for use in the liquid application of surface layer is replaced with a TMPTA (NH ester A-TMPT, manufactured by Shin-Nakamura Chemical Co., Ltd.) The sulfur concentration of the product prior to refinement is 830 ppmw. The sulfur concentration contained in the TMPTA after refinement is 35 ppmw. The sulfur concentration remaining in the surface layer is 20 ppmw. A mutation test is conducted for the TMPTA refined by the column chromatography and its colony increase multiple is 1.1.

Example 5

The liquid application of surface layer is prepared in the same manner as in Example 1 except that the radical polymerizable monomer having at least 3 functional groups with no charge transport structure for use in the liquid application of surface layer is replaced with a TMPTA (TMPTA, manufactured by Tokyo Kasei Kogyo Co., Ltd.). The sulfur concentration of the product prior to refinement is 940 ppmw. The sulfur concentration contained in the TMPTA after refinement is 45 ppmw. The sulfur concentration remaining in the surface layer is 30 ppmw. A mutation test is conducted for the TMPTA refined by the column chromatography and its colony increase multiple is 1.4.

Comparative Example 1

The liquid application of surface layer is prepared in the same manner as in Example 1 except that the radical polymerizable monomer having at least 3 functional groups with no charge transport structure for use in the liquid application of surface layer is replaced with a TMPTA (Aronix M-309, manufactured by TOA GOSEI CO., LTD.) The sulfur concentration remaining in the surface layer is measured and the result is 100 ppmw.

A mutation test is conducted for the TMPTA prior to refinement and its colony increase multiple is 3.4. The sulfur concentration in the surface layer, the sulfur concentration of TMPTA, and the colony increase multiple are shown in Table 3.

Machine Running Test with Actual Paper

The manufactured image bearing member is installed into a printer (imagio Neo 1050 Pro, manufactured by Ricoh Co., Ltd.) and an actual machine running test is performed with a run length of 2 million sheets (A4, My Paper, manufactured by NBS Ricoh Co., Ltd.) to evaluates properties such as abrasion characteristics (amount of abrasion), voltage in the machine, and image quality (S3-chart evaluation).

The results are shown in Table 3.

Example 6

Liquid application having the following recipe is applied to an aluminum substrate (outer diameter: 100 mm Φ) by a dip coating method to form an undercoating layer having a layer thickness of 1.5 μm after drying.

| Liquid Application for Undercoating Layer | |
|---|---|
| Alcohol soluble nylon (Product name: CM8000, manufactured by Toray industries Inc.) | 5 parts |
| Butanol | 45 parts |
| Methanol | 45 parts |

Liquid application for charge generation layer containing the titanyl phthalocyanine pigment is applied to the undercoating layer by a dip coating followed by heating and drying to form a charge generation layer having a layer thickness of 0.5 μm.

| Liquid Application for Charge Generation Layer | |
|---|---|
| Titanyl phtahlocyanine pigment manufactured in Synthesis Example 1 | 2.5 parts |
| Polyvinyl butyral (BM-S, manufactured by Sekisui Chemical Co., Ltd.) | 1.0 part |
| Methylethylketone | 100 parts |

Liquid application for charge transport layer containing the following materials is applied to the charge generation layer by a dip coating followed by heating and drying to form a charge transport layer having a layer thickness of 15 μm.

| Liquid Application for Charge Transport Layer | |
|---|---|
| Bisphenol Z type polycarbonate | 9 parts |
| Charge transport compound represented by the following chemical formula | 9 parts |

Chemical formula 9

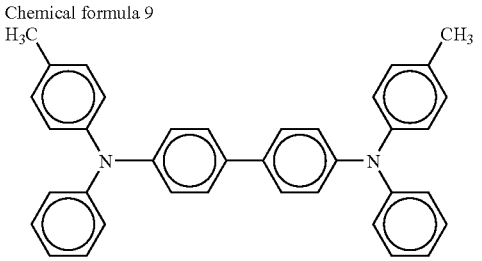

The liquid application of a surface layer having the following recipe is spray-coated on the charge transport layer. A photoreceptor drum is installed in an optical energy irradiation tank and irradiated with light. Ultraviolet irradiator (manufactured by Fusion Co., Ltd) including an H valve having a strong emission energy in the range of from 200 to 280 nm as the light source is used to irradiate the drum under the conditions of input voltage of 240 mW/cm$^2$, and irradiation time of 180 sec. followed by a 30 minute drying at 130 degree C. to obtain a photoreceptor having a surface layer with a thickness of 10 micro meter.

Grind down the surface layer in an amount of 1 mg and measure the sulfur concentration by the combustion decomposition-ion chromatography. The result is 45 ppmw.

Liquid Application for Surface Layer

The sulfur concentration of TMPTA (Aronix M-309, manufactured by TOA GOSEI CO., LTD.) used as the radical polymerizable monomer having at least 3 functional groups with no charge transport structure is measured and the result is 180 ppmw. This TMPTA is absorbed and refined by activated white earth (manufactured by Wako Pure Chemical Industries, Ltd.). The TMPTA is subject to the absorption treatment twice.

The sulfur concentration absorbed and refined by activated white earth is 74 ppmw. A mutation test is conducted for the TMPTA refined by absorption refinement and its colony increase multiple is 2.5.

| | |
|---|---|
| TMPTA refined according to the absorption refinement method described above | 10 parts |

Chemical formula 10

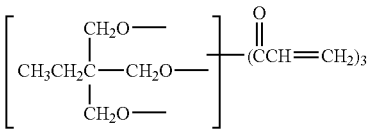

| | |
|---|---|
| Radical polymerizable compound having one functional group with a charge transport structure | 10 parts |

Chemical formula 11

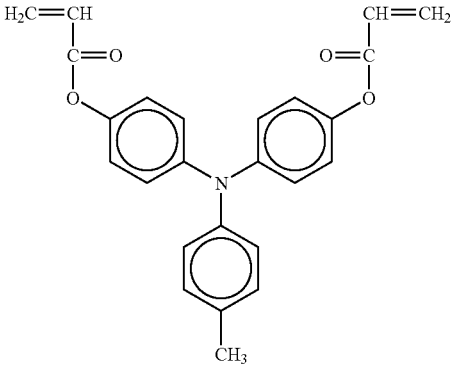

The sulfur concentration of the radical polymerizable compound having a charge transport structure is measured and the result is 4 ppmw.

| | |
|---|---|
| Photo polymerization initiator | 0.5 parts |

Chemical formula 12

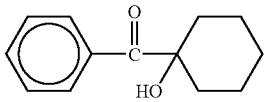

| | |
|---|---|
| Tetrahydrofuran | 80 parts |

Example 7

The liquid application of surface layer is prepared in the same manner as in Example 1 except that the absorbent is replaced with basic activated alumina (Merck KGaA). The sulfur concentration contained in the TMPTA after refinement is 48 ppmw. The sulfur concentration remaining in the surface layer is 25 ppmw. A mutation test is conducted for the TMPTA refined by absorption refinement and its colony increase multiple is 1.9.

Example 8

The liquid application of surface layer is prepared in the same manner as in Example 6 except that the absorbent is replaced with acid activated alumina (Merck KGaA). The sulfur concentration contained in the TMPTA after refinement is 90 ppmw. The sulfur concentration remaining in the surface layer is 47 ppmw. A mutation test is conducted for the TMPTA refined by absorption refinement and its colony increase multiple is 2.6.

Comparative Example 2

The liquid application of surface layer is prepared in the same manner as in Example 6 except that the absorbent is replaced with sodium acetate trihydrate (manufactured by Wako Pure Chemical Industries, Ltd.). The sulfur concentration contained in the TMPTA after refinement is 100 ppmw. The sulfur concentration remaining in the surface layer is 53 ppmw.

A mutation test is conducted for the TMPTA refined by absorption refinement and its colony increase multiple is 2.7.

Comparative Example 3

The liquid application of surface layer is prepared in the same manner as in Example 6 except that the absorbent is replaced with sodium hydrogen carbonate (manufactured by Kishida Chemical Co., Ltd.). The sulfur concentration contained in the TMPTA after refinement is 100 ppmw. The sulfur concentration remaining in the surface layer is 58 ppmw. A mutation test is conducted for the TMPTA refined by absorption refinement and its colony increase multiple is 2.7. The sulfur concentration in the surface layer, the sulfur concentration of TMPTA, and the colony increase multiple are shown in Table 3.

Machine Running Test with Actual Paper

The manufactured image bearing member is installed into a printer (imagio Neo C600, manufactured by Ricoh Co., Ltd.) and an actual machine running test is performed with a run length of 2 million sheets (A4, My Paper, manufactured by PUBS Ricoh Co., Ltd.) to evaluates properties such as abrasion characteristics (amount of abrasion), voltage in the machine, and image quality (S3-chart evaluation). The results are shown in Table Example 9

The aluminum substrate (having an outer diameter of 100 mm) is anodized followed by sealing treatment.

Liquid application for charge generation layer containing the titanyl phthalocyanine pigment is applied to the substrate by a dip coating followed by heating and drying to form a charge generation layer having a layer thickness of 0.3 μm.

| Liquid Application for Charge Generation Layer | |
|---|---|
| Titanyl phtahlocyanine pigment manufactured by Synthesis Example 1 | 2.5 parts |
| Polyvinyl butyral (BM-S, manufactured by Sekisui Chemical Co., Ltd.) | 1.0 part |
| Methylethylketone | 100 parts |

Liquid application for charge transport layer containing the following materials is applied to the charge generation layer by a dip coating followed by heating and drying to form a charge transport layer having a layer thickness of 17 μm.

| Liquid Application for Charge Transport Layer | |
|---|---|
| Bisphenol Z type polycarbonate | 8 parts |
| Charge transport compound represented by the following chemical formula | 10 parts |

Chemical formula 13

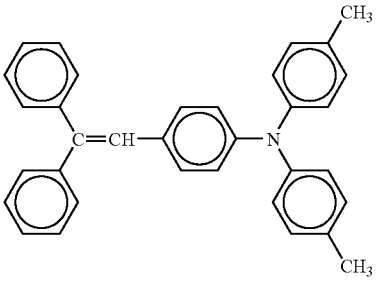

The liquid application of a surface layer having the following recipe is spray-coated on the charge transport layer. A photoreceptor drum is installed in an optical energy irradiation tank and irradiated with light. Ultraviolet irradiator (manufactured by Fusion Co., Ltd) including an H valve having a strong emission energy in the range of from 200 to 280 nm as the light source is used to irradiate the drum under the conditions of input voltage of 240 mW/cm$^2$, and irradiation time of 240 sec. followed by a 30 minute drying at 130 degree C. to obtain a photoreceptor having a surface layer with a thickness of 10 micro meter.

Grind down the surface layer in an amount of 1 mg and measure the sulfur concentration by the combustion decomposition-ion chromatography. The result is 38 ppmw.

Liquid Application for Surface Layer

The sulfur concentration of TMPTA (Aronix M-309, manufactured by TOA GOSEI CO., LTD.) used as the radical polymerizable monomer having at least 3 functional groups with no charge transport structure is measured and the result is 180 ppmw. This TMPTA is absorbed and refined by basic activated white earth (manufactured by Wako Pure Chemical Industries, Ltd.). The TMPTA is subject to the absorption treatment only once.

The sulfur concentration absorbed and refined by basic activated white earth is 60 ppmw. A mutation test is conducted for the TMPTA refined by absorption refinement and its colony increase multiple is 2.1.

| | |
|---|---|
| TMPTA refined according to the absorption refinement method described above | 10 parts |

Chemical formula 14

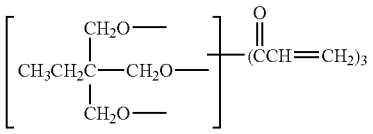

| | |
|---|---|
| Radical polymerizable compound having three functional groups with a charge transport structure | 10 parts |

Chemical formula 15

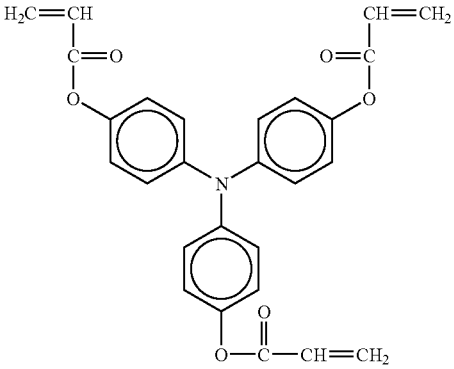

The sulfur concentration of the radical polymerizable compound having a charge transport structure is measured and the result is 6 ppmw.

| | |
|---|---|
| Photo polymerization initiator | 0.5 parts |

Chemical formula 16

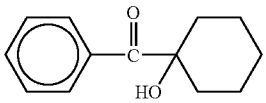

| | |
|---|---|
| Tetrahydrofuran | 80 parts |

Example 10

The liquid application of surface layer is prepared in the same manner as in Example 9 except that the number of absorption treatment is changed to four times.

The sulfur concentration contained in the TMPTA after refinement is 40 ppmw. The sulfur concentration remaining in the surface layer is 25 ppmw. A mutation test is conducted for the TMPTA refined by absorption refinement and its colony increase multiple is 1.9.

Example 11

The liquid application of surface layer is prepared in the same manner as in Example 9 except that the number of absorption treatment is changed to three times. The sulfur concentration contained in the TMPTA after refinement is 28 ppmw. The sulfur concentration remaining in the surface layer is 15 ppmw. A mutation test is conducted for the TMPTA refined by absorption refinement and its colony increase multiple is 1.4.

Example 12

The liquid application of surface layer is prepared in the same manner as in Example 9 except that the number of absorption treatment is changed to four times. The sulfur concentration contained in the TMPTA after refinement is 26 ppmw. The sulfur concentration remaining in the surface layer is 16 ppmw. A mutation test is conducted for the TMPTA refined by absorption refinement and its colony increase multiple is 1.4.

The sulfur concentration in the surface layer, the sulfur concentration of TMPTA, and the colony increase multiple are shown in Table 3.

TABLE 3

Machine Running Test with Actual Paper

| | TMPTA Product name | Refinement method | Absorbent | # of absorption | Sulfur density (ppmw) Before | After | Surface layer |
|---|---|---|---|---|---|---|---|
| Ex. 1 | M-309 | Column cromato. | | | 180 | 20 | 5 |
| Ex. 2 | V#295 | Column cromato. | | | 110 | 30 | 15 |
| Ex. 3 | kayarad | Column cromato. | | | 310 | 30 | 20 |
| Ex. 4 | A-TMPT | Column cromato. | | | 830 | 35 | 20 |
| Ex. 5 | TMPTA | Column cromato. | | | 940 | 45 | 30 |
| Ex. 6 | M-309 | Absorp. | Activated white earth | Twice | 180 | 74 | 45 |
| Ex. 7 | M-309 | Absorp. | Activated basic alumina | Twice | 180 | 48 | 25 |
| Ex. 8 | M-309 | Absorp. | Activated acid alumina | Twice | 180 | 90 | 47 |
| Ex. 9 | M-309 | Absorp. | Activated basic alumina | Once | 180 | 60 | 38 |
| Ex. 10 | M-309 | Absorp. | Activated basic alumina | Twice | 180 | 40 | 25 |
| Ex. 11 | M-309 | Absorp. | Activated basic alumina | Three times | 180 | 28 | 15 |
| Ex. 12 | M-309 | Absorp. | Activated basic alumina | Four times | 180 | 26 | 16 |
| Comp. 1 | M-309 | None | | | 180 | | 100 |
| Comp. 2 | M-309 | Absorp. | Sodium acetate tri-hydrate | Twice | 180 | 100 | 53 |
| Comp. 3 | M-309 | Absorp. | sodium hydrogen carbonate | Twice | 180 | 100 | 38 |

| | Colony increase multiple | Voltage (-V) in the machine: Initial Dark | Initial irradiated | 1 million Dark | 1 million irradiated | 2 million Dark | 2 million irradiated |
|---|---|---|---|---|---|---|---|
| Ex. 1 | 1.2 | 800 | 147 | 784 | 157 | 174 | 174 |
| Ex. 2 | 1.1 | 800 | 146 | 788 | 156 | 173 | 173 |
| Ex. 3 | 1.2 | 800 | 144 | 797 | 155 | 182 | 182 |
| Ex. 4 | 1.1 | 800 | 141 | 770 | 168 | 184 | 184 |
| Ex. 5 | 1.4 | 800 | 148 | 764 | 165 | 188 | 188 |
| Ex. 6 | 2.5 | 800 | 167 | 788 | 187 | 774 | 197 |
| Ex. 7 | 1.9 | 800 | 164 | 792 | 174 | 781 | 183 |
| Ex. 8 | 2.6 | 800 | 164 | 794 | 190 | 750 | 210 |
| Ex. 9 | 2.1 | 800 | 167 | 768 | 184 | 748 | 194 |
| Ex. 10 | 1.9 | 800 | 164 | 774 | 180 | 753 | 190 |
| Ex. 11 | 1.4 | 800 | 164 | 776 | 179 | 754 | 190 |
| Ex. 12 | 1.4 | 800 | 162 | 780 | 176 | 764 | 186 |
| Comp. 1 | 3.4 | 800 | 141 | 687 | 188 | 563 | 286 |

TABLE 3-continued

| Machine Running Test with Actual Paper | | | | | | | |
|---|---|---|---|---|---|---|---|
| Comp. 2 | 2.7 | 800 | 172 | 742 | 205 | 690 | 250 |
| Comp. 3 | 2.7 | 800 | 175 | 720 | 215 | 650 | 297 |

| | Image Characteristics | | |
|---|---|---|---|
| | Initial | 1 million | 2 million |
| Ex. 1 | G | G | G |
| Ex. 2 | G | G | G |
| Ex. 3 | G | G | G |
| Ex. 4 | G | G | G |
| Ex. 5 | G | G | G |
| Ex. 6 | G | G | F |
| Ex. 7 | G | G | G |
| Ex. 8 | G | G | F |
| Ex. 9 | G | G | F |
| Ex. 10 | G | G | G |
| Ex. 11 | G | G | G |
| Ex. 12 | G | G | G |
| Comp. 1 | G | F | B |
| Comp. 2 | G | F | F |
| Comp. 3 | G | F | B |

The manufactured image bearing member is installed into a printer (imagio Neo C600, manufactured by Ricoh Co., Ltd.) and an actual machine running test is performed with a run length of 2 million sheets (A4, My Paper, manufactured by NBS Ricoh Co., Ltd.) to evaluates properties such as abrasion characteristics (amount of abrasion), voltage in the machine, and image quality (S3-chart evaluation). The results are shown in Table 3.

In Table 3, Image Characteristics are evaluated according to the following criteria:

G (Good): Image density with no problem

F (Fair): Slightly thin image density

Bad (B): Thin image density

As shown in Table 3, Examples 1 to 12 show good image characteristics after a run length of 1 million sheets in the actual machine running test. Particularly, Examples 1 to 5, 7 and 10 to 12 show excellent image characteristics even after a run length of 2 million sheets, meaning that the photoreceptors thereof have excellent durability.

This document claims priority and contains subject matter related to Japanese Patent Application No. 2009-052636, filed on Mar. 5, 2009, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A photoreceptor comprising:

an electroconductive substrate;

a photosensitive layer located overlying the electroconductive substrate; and a surface layer located overlying the photosensitive layer, the surface layer comprising a cross-linked material of a radical polymerizable monomer having at least 3 functional groups with no charge transport structure and a radical polymerizable compound having a charge transport structure, the surface layer having a sulfur concentration of 50 ppmw or lower.

2. The photoreceptor according to claim 1, wherein the radical polymerizable monomer having at least 3 functional groups with no charge transport structure has a sulfur concentration of 50 ppmw or lower.

3. An image formation method comprising:

charging the photoreceptor of claim 1;

irradiating the photoreceptor to form a latent electrostatic image thereon;

developing the latent electrostatic image with a development agent to obtain a visualized image; and furring the visualized image to a transfer medium.

4. An image forming apparatus comprising:

the photoreceptor of claim 1;

an irradiation device that irradiates the photoreceptor with light to form a latent electrostatic image thereon;

a development device that develops the latent electrostatic image with a development agent to obtain a visualized image; and a transfer device that transfers the visualized image to a transfer medium.

5. A process cartridge detachably attachable to an image forming apparatus, comprising:

the photoreceptor of claim 1; and at least one of a charging device, a development device, a transfer device, a discharging device and a cleaning device.

6. A method of manufacturing a photoreceptor, comprising:

refining a radical polymerizable monomer having at least 3 functional groups with no charge transport structure such that the radical polymerizable monomer having at least 3 functional groups with no charge transport structure has a sulfur concentration of 90 ppmw or less;

forming a photosensitive layer comprising a charge transport material overlying an electroconductive substrate; and forming a surface layer overlying the photosensitive layer by applying a liquid application of the surface layer comprising the radical polymerizable monomer having at least 3 functional groups with no charge transport structure and a radical polymerizable compound having a charge transport structure, followed by curing and cross-linking upon application of an optical energy, whereby a sulfur concentration of the surface layer is 50 ppmw or less.

7. The method of manufacturing a photoreceptor according to claim 6, wherein, in the step of refining, the radical polymerizable monomer having at least 3 functional groups with no charge transport structure is refined such that a ratio of a total number of colonies calculated according to a mutation test of Ames Test using salmonella of TA1535 to a number of colonies of a control solvent according thereto is 2.0 at maximum.

8. The method of manufacturing a photoreceptor according to claim 7, wherein, in the step of refining, the radical polymerizable monomer having at least 3 functional groups with no charge transport structure is refined by separation refinement according to column chromatography.

9. The method of manufacturing a photoreceptor according to claim 6, wherein, in the step of refining, the radical polymerizable monomer having at least 3 functional groups with no charge transport structure is refined by absorption refinement using an absorbent.

10. The method of manufacturing a photoreceptor according to claim 9, wherein the absorbent in the step of refining is basic.

* * * * *